US010235840B2

(12) United States Patent
Arnone et al.

(10) Patent No.: US 10,235,840 B2
(45) Date of Patent: Mar. 19, 2019

(54) TIME ENABLED HYBRID GAMES

(71) Applicant: Gamblit Gaming, LLC, Glendale, CA (US)

(72) Inventors: Miles Arnone, Sherborn, MA (US); Caitlyn Ross, Watertown, MA (US); Eric Meyerhofer, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 193 days.

(21) Appl. No.: 15/439,499

(22) Filed: Feb. 22, 2017

(65) Prior Publication Data

US 2017/0161996 A1 Jun. 8, 2017

Related U.S. Application Data

(63) Continuation of application No. 14/176,014, filed as application No. PCT/US2013/021994 on Jan. 17, 2013, now abandoned.

(60) Provisional application No. 61/593,657, filed on Feb. 1, 2012, provisional application No. 61/632,112, filed on Jan. 19, 2012.

(51) Int. Cl.
*G07F 17/32* (2006.01)

(52) U.S. Cl.
CPC ..... *G07F 17/3269* (2013.01); *G07F 17/323* (2013.01); *G07F 17/3255* (2013.01); *G07F 17/3288* (2013.01); *G07F 17/3295* (2013.01)

(58) Field of Classification Search
CPC ..... G07F 17/3269; G07F 17/323; G07F 17/3255; G07F 17/3288; G07F 17/3295
See application file for complete search history.

(56) References Cited

U.S. PATENT DOCUMENTS 5,413,357 A 5/1995 Schulze et al.
5,718,429 A 2/1998 Keller
5,785,592 A 7/1998 Jacobsen
5,853,324 A 12/1998 Kami et al.
(Continued)

FOREIGN PATENT DOCUMENTS

JP 2001300098 A 10/2001
JP 2003111980 A 4/2003
(Continued)

OTHER PUBLICATIONS

U.S. Appl. No. 14/205,303 Arnone, et al., filed Mar. 11, 2014.
(Continued)

*Primary Examiner* — Corbett B Coburn
(74) *Attorney, Agent, or Firm* — Caity Ross; Frank Cire

(57) ABSTRACT

Systems and methods in accordance with embodiments of the invention operate a time enabled hybrid game. A time enabled hybrid game includes a real world engine constructed to provide a randomly generated payout of real world credits from at least one wager in a gambling game, an entertainment software engine constructed to execute an entertainment game providing outcomes based upon a player's skillful play of the entertainment game and a game world engine constructed to monitor the output of a clock during the player's skillful play of the entertainment game detect a unit of time based on the monitored output of the clock; and trigger the at least one wager in the gambling game based on the detection of the unit of time.

5 Claims, 18 Drawing Sheets

(56) References Cited

U.S. PATENT DOCUMENTS 5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Arnone
8,480,470 B2 7/2013 Napolitano et al.
8,622,809 B1 1/2014 Arora et al.
8,864,564 B2 10/2014 Oberberger
9,070,257 B1 6/2015 Scalise
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour

(56) References Cited

U.S. PATENT DOCUMENTS

2009/0118006 A1 5/2009 Kelly et al.
2009/0124344 A1 5/2009 Mitchell et al.
2009/0131158 A1* 5/2009 Brunet De Courssou ..... G07F 17/32 463/26
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0221355 A1 9/2009 Dunaevsky et al.
2009/0239610 A1 9/2009 Olive
2009/0247272 A1 10/2009 Abe
2009/0270164 A1 10/2009 Seelig
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham
2010/0035674 A1 2/2010 Slomiany
2010/0035679 A1* 2/2010 Oram ..... G07F 17/32 463/25
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184507 A1* 7/2010 Gatto ..... G07F 17/32 463/25
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1* 8/2011 Oberberger ..... G07F 17/32 463/25
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1* 10/2011 De Waal ..... A63F 7/02 463/20
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0252718 A1* 9/2013 Arnone ..... G07F 17/3262 463/25
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0135114 A1* 5/2014 Meyerhofer ..... A63F 13/792 463/26
2014/0357350 A1 12/2014 Weingardt et al.

FOREIGN PATENT DOCUMENTS

JP 2004097610 A 4/2004
JP 2004166746 A 6/2004
JP 2007502659 A 2/2007
JP 2013521061 A 6/2013
WO 9851384 A1 11/1998
WO 2010087090 A1 8/2010
WO 2011109454 A1 9/2011
WO WO-2011109454 A1 * 9/2011 ..... G07F 17/3272
WO 2012139083 A1 10/2012
WO WO-2013033048 A1 * 3/2013 ..... G07F 17/3262
WO 2013059308 A1 4/2013

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 2014.
U.S. Appl. No. 14/312,623 Arnone, et al. filed Jun. 23, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.

(56) References Cited

OTHER PUBLICATIONS

U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al., filed Dec. 30, 2014.
U.S. Appl. No. 14/586,639 Arnone, et al., filed Dec. 30, 2014.
Japan Patent Office, Office Action, Japan Patent Application No. 2014-553417, dated Nov. 29, 2016, Japan.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 14/799,481 Arnone, et al. filed Jul. 14, 2015.
U.S. Appl. No. 15/362,214 Arnone, et al. filed Nov. 28, 2016.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
Japan Patent Office, Office Action, Japan Patent Application No. 2014-553417, dated Feb. 27, 2017, Japan.
WIPO—ISA, International Search Report and Written Opinion, PCT/US13/021994, dated Mar. 29, 2013.
itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
Changing the Virtual Self: Avatar Transformations in Popular Games; Barr et al., Victoria Univ., NZ, 2006.
Real-Time Multimodal Human—Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.

(56) References Cited

OTHER PUBLICATIONS

U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/,174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.
U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.

* cited by examiner

TIME ENABLED HYBRID GAMES

CROSS REFERENCE TO RELATED APPLICATIONS

This application is a continuation of U.S. patent application Ser. No. 14/176,014, filed on Feb. 7, 2014, which is a continuation of Patent Cooperation Treaty Application No. PCT/US13/21994, filed on Jan. 17, 2013, which claims the benefit of U.S. Provisional Patent Applications Nos. 61/632,112 filed Jan. 17, 2012 and 61/593,657 filed Feb. 1, 2012, the contents of each of which are hereby incorporated by reference in their entirety as if stated in full herein. This application references Patent Cooperation Treaty Application Nos. PCT/US11/26768, filed Mar. 1, 2011, PCT/US11/63587, filed Dec. 6, 2011, and PCT/US12/58156, filed Sep. 29, 2012, the contents of each of which are incorporated by reference herein.

FIELD OF THE INVENTION

Embodiments of the present invention are generally related to gaming and more specifically to use of time as a control element within a hybrid game that includes both an entertainment game and a gambling game.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY

Systems and methods in accordance with embodiments of the invention provide for a distributed gaming system. In various embodiments, a distributed gaming system includes: an electromechanical gaming machine constructed to receive real credits from a user connected to a real world server by a communication link; the real world server connected to a game world server by a communication link, wherein the real world server is constructed to: receive from the game world server via the communication link, a trigger of a wager; execute the wager to determine a randomly generated payout of real credits using a random number generator; and distribute to the game world server via the communication link, the randomly generated payout of real credits; an entertainment software server connected to the game world server by a network, wherein the entertainment software server is constructed to: execute an entertainment game having a game world clock in a game world environment, and an entertainment game element that is consumed by an action of a player in the game world environment; distribute to the game world server via the network, an output of the game world clock and the player action; receive from the game world server via the network, control information including an amount of the entertainment game element in the game world environment; make available to the player the amount of the entertainment game element during the player's skillful play of the entertainment game; and provide outcomes based upon the player's skillful play of the entertainment game and use of the amount of the entertainment game element; generate a visual display of the entertainment game; and the game world server connected by the communication link to the real world server and connected to entertainment software server by the network, wherein the game world server is constructed to: interface the entertainment software server to the real world server over the network by: receiving from the entertainment software server via the network, the output of the game world clock and the player action; monitoring the output of the game world clock during the player's skillful play of the entertainment game; detecting passage of a unit of game world time in the game world environment based on the monitored output of the game world clock; distributing to the real world server via the communication link, the trigger of the wager in based on both the detection of the passage of the unit of game world time in the game world environment, and on the entertainment game element being consumed by the action of the player in the game world environment; receiving from the real world server via the communication link, the randomly generated payout; and controlling the entertainment software server by: determining, based on the randomly generated payout, the control information including the amount of the entertainment game element available in the game world environment to the player while playing the entertainment game; distributing to the entertainment software server via the network, the control information; and accreting, based on the randomly generated payout, an amount of game world time in the game world environment for use by the player while playing the entertainment game.

In some embodiments, triggering the wager in the gambling game further includes determining the amount of real credit committed to the wager.

In many embodiments, the amount of real credit committed to the wager is determined on the basis of the unit of game world time.

In other embodiments, the game world server and the real world server are implemented on a same processing apparatus.

In still other embodiments, the communication link connecting the game world server and the real world server utilizes the network.

DETAILED DESCRIPTION

Figure 1:
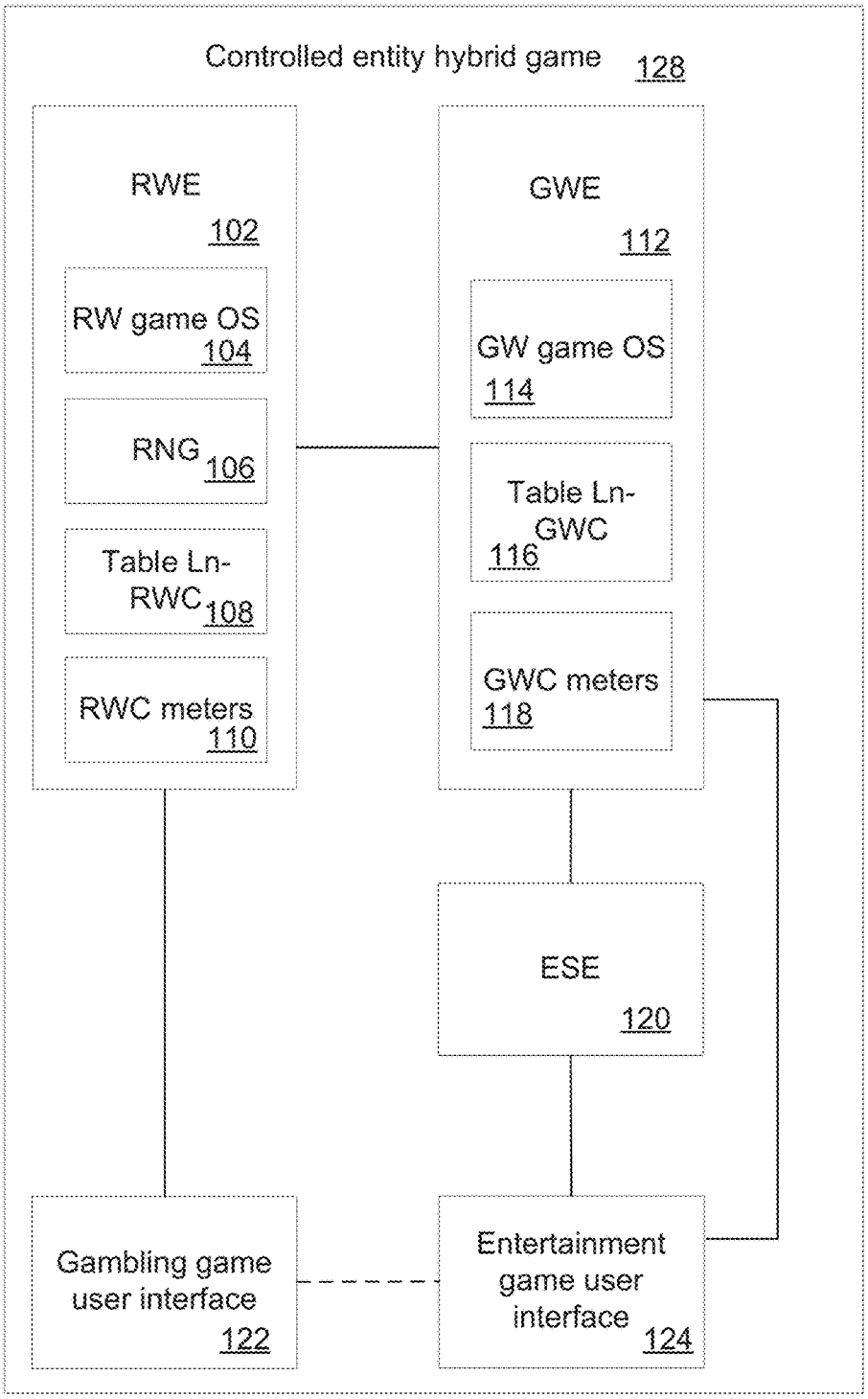
FIG. 1 illustrates a time enabled hybrid game in accordance with an embodiment of the invention.

Turning now to the drawings, systems and methods for operation of a time enabled hybrid game are illustrated. In several embodiments, a time enabled hybrid game is a form of a hybrid game in which a bet is triggered by a time detector that monitors the output of a clock. The clock may be a real time clock or a game time clock. In certain embodiments, the time enabled hybrid game also includes a user interface associated with either or both the gambling game and the entertainment game. In operation of a time enabled hybrid game, a player acts on various types of elements of the entertainment game in a game world environment. In playing the entertainment game, using the controlled entity, a player can consume and accrue game world credits (GWC) within the entertainment game. These credits can be in the form of (but are not limited to) game world objects, experience points, or points generally. Wagers or bets are made in the gambling game using real world credits (RC). The real world credits can be credits in an actual currency, or may be credits in a virtual currency which may or may not have a real world value. Gambling outcomes from the gambling game may cause consumption, loss or accrual of RC. In addition, gambling outcomes in the gambling game may influence elements in the entertainment game such as (but not limited to) by adding an element, restoring a consumed element, causing the loss of an element, restoration of an element, or placement of an element. Example elements include (but are not limited to) enabling elements (EE) which are elements that enable a player's play of the entertainment game and whose consumption by the controlled entity while playing the entertainment game may trigger a wager in the gambling game. In addition, EE may also be replenished during play within the entertainment game based on an outcome of a triggered wager. Other types of elements include actionable elements (AE), which are elements that are acted upon to trigger a wager in the gambling game and may not be restorable during normal play of the entertainment game, and collective enabling elements (CEE). Various hybrid games are discussed in Patent Cooperation Treaty Application No. PCT/US11/26768, filed Mar. 1, 2011, entitled "ENRICHED game PLAY ENVIRONMENT (SINGLE and/or MULTI-PLAYER) FOR CASINO APPLICATIONS" and Patent Cooperation Treaty Application No. PCT/US11/63587, filed Dec. 6, 2011, entitled "ENHANCED SLOT-MACHINE FOR CASINO APPLICATIONS" each disclosure of which is hereby incorporated by reference in its entirety.

Time Enabled Hybrid games

In many embodiments, a time enabled hybrid game is a form of a hybrid game in which a bet is triggered by a time detector that monitors the output of a clock. The clock may be a real time clock or a game time clock. In some embodiments, a single time detector may monitor one or more such clocks within a time enabled hybrid game. In various embodiments, once a unit of time is detected, a function triggers a bet or wager in a gambling game by determining an amount of real world credit to be committed to the bet or wager, and then communicating the determined amount of real world credit to the gambling game. In various embodiments, the determination as to the amount of real world credit to be committed to the gambling game is a function of a wager value per unit of time. In many embodiments, the wagering function may also take into account the state of the entertainment game, the values of certain entertainment game parameters and/or a change in the state of the entertainment game.

In various embodiments, once the wager takes place, if a winning result is achieved, real world credit is returned to the player, and an entertainment game function establishes how much (if any) additional time is to be accreted to an amount of play time remaining to the player.

In some embodiments, the amount of real world credit generated also affects, via another function, an amount of an enabling element available to a player or the player's controlled entity in the game.

In many embodiments, the game clock output is input to display logic that, as part of an entertainment game, conditions this output for display to the player. The display logic can perform mathematical (for example integrate, subtract, add) and/or logic functions on the clock output and display the results of these function(s) and/or convey this information to other subsystems within time enabled hybrid game.

A time enabled hybrid game can be used to generate a rich gameplay experience. As is discussed further below, any of a variety of different time enabled hybrid game scenarios can be utilized including (but not limited to) war themed time enabled hybrid games, sports themed time enabled hybrid games, and racing themed time enabled hybrid games.

In many embodiments, a time enabled hybrid game integrates high levels of entertainment content with a game of skill (entertainment game), a gambling experience with a game of chance (gambling game). A time enabled hybrid game provides for random outcomes independent of player skill while providing that the user's gaming experience (as measured by obstacles/challenges encountered, time of play and other factors) is shaped by the player's skill. A time enabled hybrid game in accordance with an embodiment of the invention is illustrated in FIG. 1. The time enabled hybrid game 128 includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the time enabled hybrid game 128 and controls and operates the gambling game. The operation of a gambling game is enabled by RC, such as money, real world funds, or a virtual currency. A gambling game can increase or decreases an amount of RC based on random gambling outcomes, where the gambling proposition of a gambling game is typically regulated by gaming control bodies. In many embodiments, the RWE includes a RW operating system (OS) 104, random number generator (RNG) 106, level "n" real-world credit pay tables (Table Ln-RC) 108, RC meters 110 and other software constructs that enable a game of chance to offer a fair and transparent gambling proposition, and to include the auditable systems and functions that can enable the game to obtain gaming regulatory body approval.

A random number generator (RNG) 106 includes software and/or hardware algorithms and/or processes, which are used to generate random outcomes. A level "n" real-world credit pay table (Table Ln-RC) 108 is a table that can be used in conjunction with a random number generator (RNG) 106 to dictate the real world credits (RC) earned as a function of sponsored gameplay and is analogous to the pay tables used in a conventional slot machine. Table Ln-RC payouts are independent of player skill. There may be one or a plurality of Table Ln-RC pay tables 108 included in a gambling game, the selection of which may be determined by factors including (but not limited to) game progress a player has earned, and/or bonus rounds which a player may be eligible for. Real world credits (RC) are credits analogous to slot machine game credits, which are entered into a gambling game by the user, either in the form of money such as hard currency or electronic funds. RC can be decremented or augmented based on the outcome of a random number generator according to the Table Ln-RC real world credits pay table 108, independent of player skill. In certain embodiments, an amount of RC can be required to enter higher ESE game levels. RC can be carried forward to higher game levels or paid out if a cash out is opted for by a player. The amount of RC required to enter a specific level of the game "level n" need not be the same for each level.

In many embodiments, the GWE 112 manages the overall time enabled hybrid game operation, with the RWE 102 and the ESE 120 effectively being support units to the GWE 112. In several embodiments, the GWE 112 includes mechanical, electronic and software system for an entertainment game. The GWE 112 includes a GW game operating system (OS) 114 that provides control of the entertainment game. The GWE additionally includes a level "n" game world credit pay table (Table Ln-GWC) 116 from where to take input from this table to affect the play of the entertainment game. The GWE 112 can further couple to the RWE 102 to determine the amount of RC available on the game and other metrics of wagering on the gambling game (and potentially affect the amount of RC in play on the RWE). The GWE additionally includes various audit logs and activity meters (such as the GWC meter) 118. The GWE 112 can also couple to a centralized server for exchanging various data related to the player and their activities on the game. The GWE 112 furthermore couples to the ESE 120.

In many embodiments, a level "n" game world credit pay table (Table Ln-GWC) 116 dictates the GWC earned as a function of player skill in the nth level of the game. The payouts governed by this table are dependent upon player skill and sponsored gameplay at large and may or may not be coupled to a random number generator. In several embodiments, game world credits (GWC) are player points earned or depleted as a function of player skill, i.e. as a function of player performance in the context of the game. GWC is analogous to the "score" in a typical video game. Each entertainment game has one or more scoring criterion, embedded within the Table Ln-GWC 116 that reflects player performance against the goal(s) of the game. GWC can be carried forward from one level of sponsored gameplay to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE does not affect the RWE's gambling operation except for player choice parameters that are allowable in slot machines today including but not limited to the wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RC available in the gambling game. The communication link can also convey a necessary status operation of the RWE (such as on-line or tilt). The communication link can further communicate the various gambling control factors which the RWE 102 uses as input, such as the number of RC consumed per game or the player's election to enter a jackpot round. In FIG. 1, the GWE 112 is also shown as connecting to the player's user interface directly, as this may be necessary to communicate certain entertainment game club points, player status, control the selection of choices and messages which a player may find useful in order to adjust their entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In numerous embodiments, an ESE can be an electromechanical game system of a time enabled hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

In many embodiments, the ESE 120 operates mostly independently from the GWE 112, except that via the interface, the GWE 112 may send certain GW game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of entertainment games at different gameplay layers interconnected during a gameplay session with gameplay impact from player actions at one gameplay layer applied to gameplay at another gameplay layer including but not limited to popular titles from arcade and home video games, such as but not limited to Gears of War (a third person shooter game developed by Epic games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RC in play, and amount of RC available. The RWE 102 can accept modifications in the amount of RC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, a time enabled hybrid game integrates a video game style gambling machine, where the gambling game (i.e. RWE 102 and RC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate "gamers" can be established with the entertainment game. In several embodiments, the time enabled hybrid game can leverage very popular titles with "gamers" and provides a sea change environment for casinos to attract players with games that are more akin to the type of entertainment that a younger generation desires. In various embodiments, players can use their skill towards building and banking GWC that in turn can be used to win tournaments and various prizes as a function of their "gamer" prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, time enabled hybrid games also allow players to gain entry into subsequent competitions through the accumulation of game world credits (GWC) that accrue as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE, the outcomes of which are dependent at least in part on skill. The time enabled hybrid game can include an entertainment game that includes head-to-head play between a single player and the computer, between two or more players against one another, or multiple players playing against the computer and/or each other, as well as the process by which players bet on the outcome of the entertainment game.

Network Connected Time Enabled Hybrid Games

Time enabled hybrid games in accordance with many embodiments of the invention can operate locally while being network connected to draw services from remote locations or to communicate with other time enabled hybrid games. In many embodiments, operations associated with a time enabled hybrid game such as (but not limited to) processes for calculating score or RC and GWC tracking can be performed across multiple devices. These multiple devices can be implemented using a single server or a plurality of servers such that a time enabled hybrid game is executed as a system in a virtualized space, such as (but not limited to) where the RWE, GWE are centralized servers "in the cloud" coupled to a plurality of widely distributed ESE controllers or clients via the Internet. In other embodiments, an ESE controller may be implemented as a server on a network as well.

In many embodiments, an RWE server can perform certain functionalities of a RWE of a time enabled hybrid game. In certain embodiments, a RWE server includes a centralized odds engine which can generate random outcomes (such as but not limited to win/loss outcomes) for a gambling game, thereby eliminating the need to have that functionality of the RWE performed locally within the time enabled hybrid game. The RWE server can perform a number of simultaneous or pseudo-simultaneous runs in order to generate random outcomes for a variety of odds percentages that one or more networked time enabled hybrid games may require. In certain embodiments, an RWE of a time enabled hybrid game can send information to a RWE server including (but not limited to) Table Ln-RC tables, maximum speed of play for a gambling game, gambling game monetary denominations or any promotional RC provided by the operator of the time enabled hybrid game. In particular embodiments, a RWE server can send information to a RWE of a time enabled hybrid game including (but not limited to) RC used in the gambling game, player profile information or play activity and a profile associated with a player.

In several embodiments, a GWE server can perform the functionality of the GWE across various time enabled hybrid games. These functionalities can include (but are not limited to) providing a method for monitoring high scores on select groups of games, coordinating interactions between gameplay layers, linking groups of games in order to join them in head-to-head tournaments, and acting as a tournament manager. A time enabled module can execute as part of a GWE server to coordinate the gameplay impact from player actions applied to player and/or player classes at various gameplay layers within a time enabled hybrid game.

In a variety of embodiments, management of player profile information can be performed by a GWE patron management server separate from a GWE server. A GWE patron management server can manage information related to a player profile, including (but not limited to) data concerning players' characters, players' game scores, players' RC and GWC and managing tournament reservations. Although a GWE patron management server is discussed separate from a GWE server, in certain embodiments a GWE server also performs the functions of a GWE patron management server. In certain embodiments, a GWE of a time enabled hybrid game can send information to a GW patron management server including (but not limited to) GWC and RC used in a game, player profile information, play activity and profile information for players and synchronization information between a gambling game and an entertainment game or other aspects of a time enabled hybrid game. In particular embodiments, a GW patron management server can send information to a GWE of a time enabled hybrid game including (but not limited to) entertainment game title and type, tournament information, Table Ln-GWC tables, special offers, character or profile setup and synchronization information between a gambling game and an entertainment game or other aspects of a time enabled hybrid game. A time enabled module can execute as part of a GWE patron management server to coordinate the gameplay impact from player actions applied to players and/or player classes at various gameplay layers within a time enabled hybrid game.

In numerous embodiments, an ESE server provides a host for managing head-to-head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

In several embodiments, a time enabled server can be connected with a time enabled hybrid game and can implement a time enabled module to coordinate the activities of a time enabled hybrid game. A time enabled module can execute as part of a time enabled server to coordinate the gameplay impact from player actions applied to players and/or player classes at various gameplay layers within a time enabled hybrid game. In numerous embodiments, a time enabled server can be part of a distributed system where processes of a time enabled server occur across different time enabled servers of a time enabled server system.

Servers connected via a network to implement time enabled hybrid games in accordance with many embodiments of the invention can communicate with each other to provide services utilized within a time enabled hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the time enabled hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of a time enabled hybrid game tournament. Typically a GWE (such as a GWE that runs within a time enabled hybrid game or on a GWE server) is not aware of the relationship of itself to the rest of a tournament since in a typical configuration the actual tournament play is managed by the ESE server. Therefore, management of a time enabled hybrid game tournament can include (but is not limited to) tasks such as: conducting tournaments according to system programming that can be coordinated by an operator of the time enabled hybrid game; allowing entry of a particular player into a tournament; communicating the number of players in a tournament and the status of the tournament (such as but not limited to the amount of surviving players, their status within the game, time remaining on the tournament); communicating the status of an ESE included in a game; communicating the performance of its players within the tournament; communicating the scores of the various members in the tournament; and providing a synchronizing link to connect the GWEs in a tournament, with their respective ESE's.

In several embodiments a GWE server can communicate with a GW patron server. A GWE server can communicate with a GW patron server to communicate any type of information as appropriate for a specific application, including (but not limited to) information for configuring tournaments according to system programming conducted by an operator of a time enabled hybrid game, exchange of data necessary to link a player's player profile to their ability to participate in various forms of sponsored gameplay (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game included GWE and ESE performance to suit preferences of a player on a particular time enabled hybrid game, as recorded in their player profile, determining a player's play and gambling performance for the purposes of marketing intelligence, and logging secondary drawing awards, tournament prizes, RC and GWC into the player profile.

In many embodiments, the actual location of where various algorithms and functions are executed may be located either in the game included devices (RWE, GWE, ESE), on the servers (RWE server, GWE server, or ESE server), or a combination of both. In particular embodiments, certain functions of a RWE server, GWE server, GW patron server or ESE server may operate on the local RWE, GWE or ESE included with a time enabled hybrid game locally. In certain embodiments, a server is a server system including a plurality of servers, where software may be run on one or more physical devices. Similarly, in particular embodiments, multiple servers may be combined on a single physical device.

Figure 2:
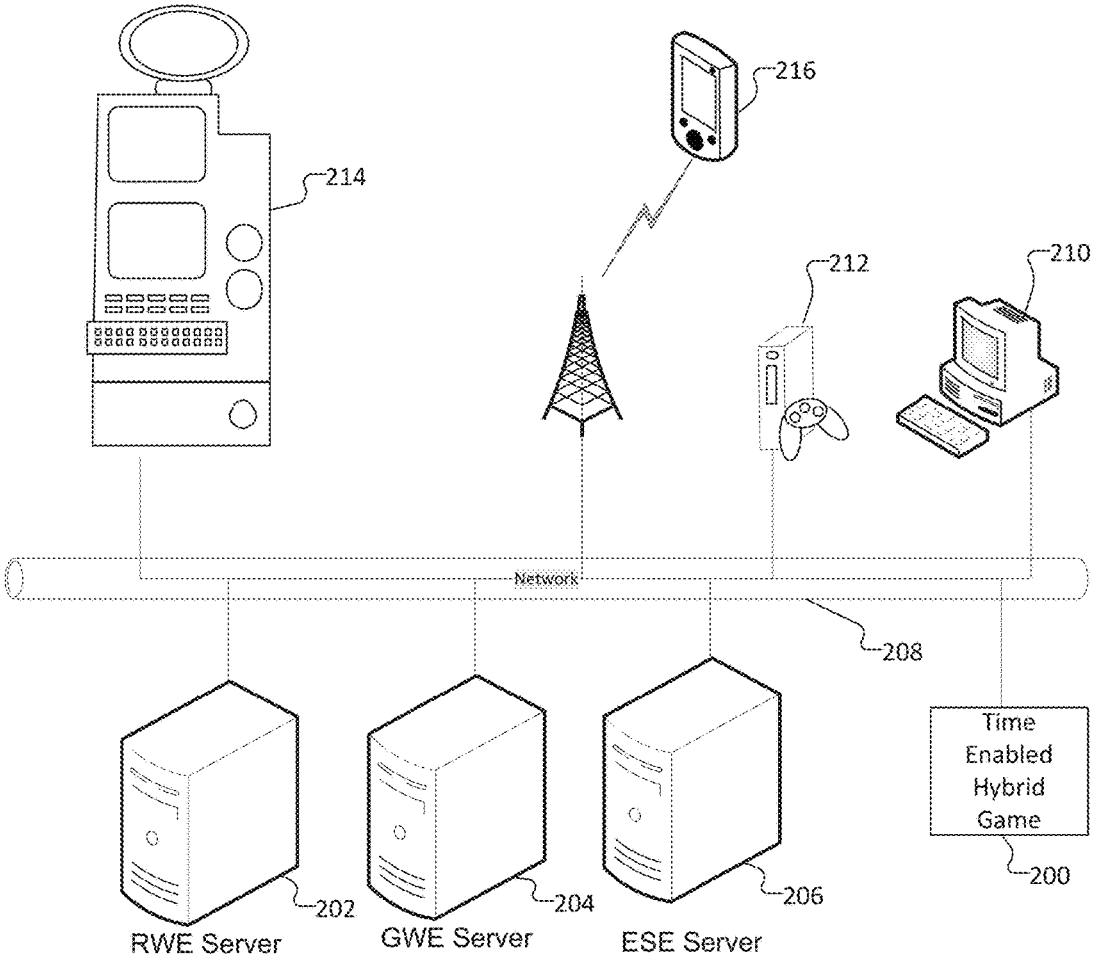
FIG. 2 is a system diagram that illustrates a network distributed time enabled hybrid game in accordance with an embodiment of the invention.

Various components of time enabled hybrid games in accordance with many embodiments of the invention can be networked with remote servers in various configurations. A networked time enabled hybrid game in accordance with an embodiment of the invention is illustrated in FIG. 2. The networked time enabled hybrid game 200 is connected with an RWE server 202, a GWE server 204, and an ESE server 206 over a network 208, such as (but not limited to) the Internet. Servers networked with a networked time enabled hybrid game 200 can also communicate with each of the components of a networked time enabled hybrid game and amongst the other servers in communication with the networked time enabled hybrid game 200.

In various embodiments, time enabled hybrid games may be implemented, in whole or in part, on a variety of devices, including, but not limited to, a personal computer 210, a gaming console 212, a casino game housed in a cabinet 214, or a mobile device 216 such as a tablet computer or smartphone.

Although various networked time enabled hybrid games are discussed above, networked time enabled hybrid games can be configured in any manner as appropriate to the requirements of a specific application in accordance with embodiments of the invention.

Among factors in the functioning of a time enabled hybrid game are one or more enabling elements (EE), one or more actionable elements (AE), one or more controlled entities (CE) and their interoperability with the game.

EEs for a time enabled hybrid game include types of consumable commodities and/or accumulating elements in a game context utilized to play and operate characters or take actions in a game space. Types of EE include (but are not limited to): weapons ammunition, health points in a fighting game, potions in the case of a fantasy game, fuel in the case of a driving game, time in the case of a game where one races against the clock to achieve some objective, armies in the case of a military strategy game, or downs in the case of football. The nature of EE is a function of the type of entertainment game executed on the ESE and its structure. In some embodiments, the consumption of EE in the process of playing the ESE entertainment game would trigger gambling plays on the RWE portion of the time enabled hybrid game. In various embodiments, it is also possible that the events of or acts of accumulation of EE in the entertainment game might also trigger RWE gambling plays in the same manner that consumption of EE would. Additionally, in some embodiments, it is possible that EE is recycled. The recycling or reuse of EE might also trigger RWE gambling plays. This is to say that games could use either EE consumption, EE accumulation, EE recycling or a combination of events to trigger RWE wagers. The correlation of what events resulting in the accumulation or consumption of EE might trigger RWE plays, and when, and the amount of RC wagered as a result of these events, would be a function of algorithms and formulae operating within the GWE and the time enabled hybrid game. It should be understood that as consistent with time enabled hybrid game methods that other triggers for RWE plays other than EE consumption or accumulation could be possible.

Like EE, an AE can initiate a gambling game by committing RC to the gambling proposition within the RWE. Like an EE, AE may be consumed, recycled or accumulated. AEs, are tied to specific player decisions or player directed actions that are undertaken in the context of the entertainment game, the outcome of those decisions or actions, or a game event or milestone points, or the transpiring of real or virtual game time in the process of playing the entertainment game. AEs, are constructs within the GW affected by player world decisions or actions subject to various formulae and algorithms as to whether the player world action or decision causes the AE to transpire.

A controlled entity (CE) includes, but is not limited to, a player's game world character, an entity, an inanimate object, a device or other object under control of the player.

Figure 3:
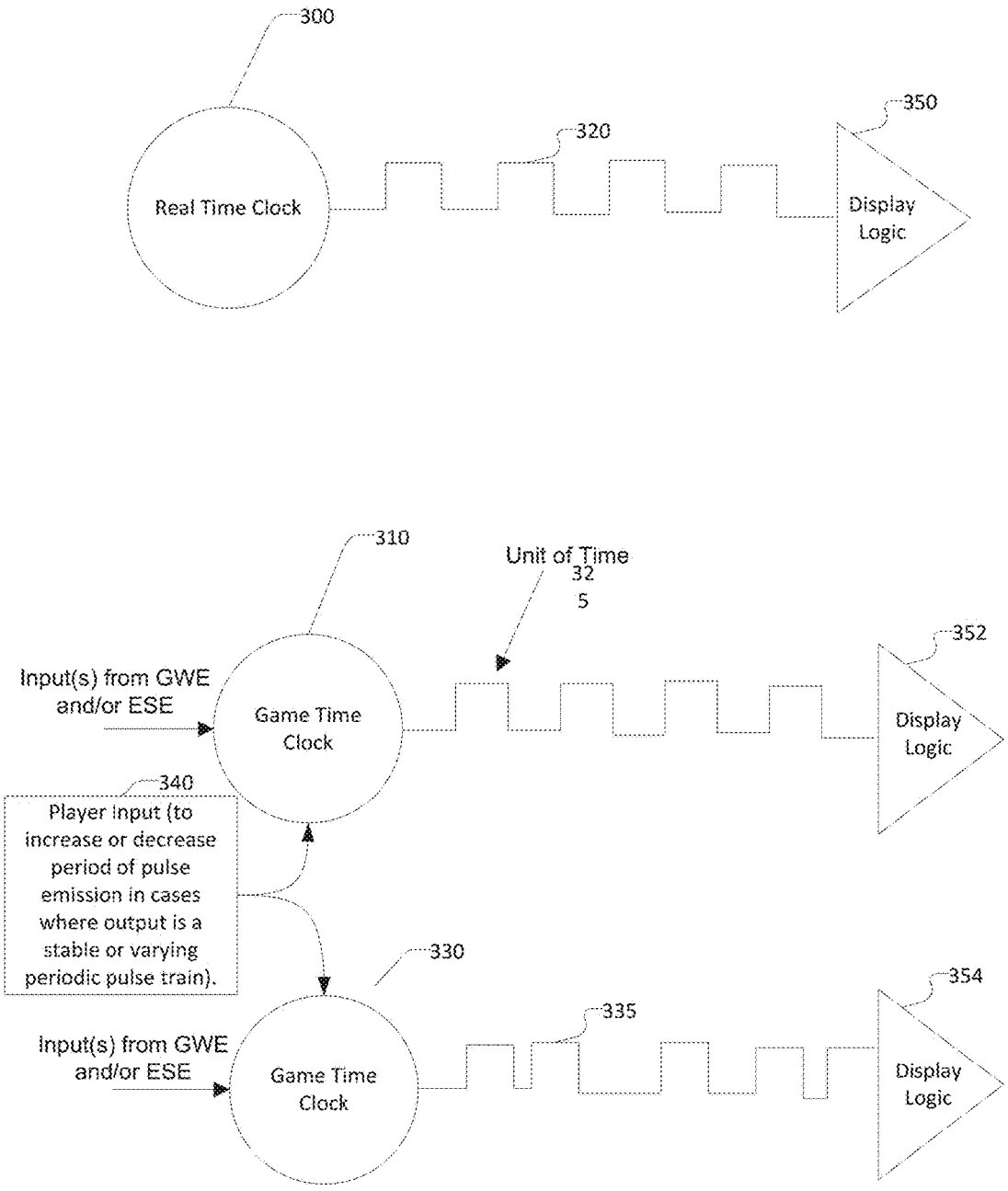
FIG. 3 is a flow chart illustrating a process of a time enabled hybrid game in accordance with an embodiment of the invention.

FIG. 3 is a flow chart illustrating a process of a time enabled hybrid game in accordance with an embodiment of the invention. In some embodiments, the time enabled hybrid game may include one or more real time clocks 300 and/or game time clocks 310. The clock or clocks can be resident within the GWE or the ESE, with communication between both modules allowing a pulse train 320 generated by the clock or clocks to be accessed by subsystems of the time enabled hybrid game.

In some embodiments, the real time clock 300 outputs a series of pulses 320 (or units of time) with constant period or regular interval. These periods or intervals correspond, at some level to time in the real-world, i.e. hours, minutes, seconds, etc.

In various embodiments, the game time clock 310 outputs a series of pulses 325 (or units of time) with a constant period, or a game time clock 330 outputs an irregular series of pulses 335 without a constant period or with a period that is constant only for a certain period of time before changing. These pulses may or may not be inherently tied to real time in any way. In some embodiments, the period can change with time, or each pulse (or series of pulses) can be output as a function of one or more inputs 340 received (for example a periodic function, when in force, can be parameterized as a function of such inputs.)

In one embodiment, a real time clock 300 would be a clock that outputs a pulse train 320 with period of 1 minute.

In another embodiment, a game time clock 310 would be a clock that, in an adventure game, outputs a pulse each "Hectarian Quadro", where a Hectarian Quadro represents a single rotation of the planet Hectarian around its star.

In some embodiments, a civilization building game set in ancient Greece is implemented using a time enabled hybrid game, where the game time clock 310 may emit a pulse coincident with the passing of a decade in the game world, a decade being considered to have elapsed when a player completes a specific set of actions related to game play (such as a migration phase, a battle phase and then a construction phase).

In another embodiment, where an adventure game is implemented using a time enabled hybrid game, the adventure game has two modes of play, movement and combat. In movement mode, the game time clock 330 emits a pulse (unit of time) each week of game time, as controlled entities traverse varied terrain as part of a quest. When the controlled entities are engaged in battle with monsters they encounter, the game time clock 330 may emit a pulse (unit of time) for each minute (in game time not real time) of hand-to-hand combat.

In another embodiment, where players' CEs are black bears and the entertainment game consists of living the life of the bears, a unit of time may be generated by the game time clock 330 for each week that the bear is hibernating during the winter, and for each day when the bear is awake, as in the spring, summer and fall.

In another embodiment, in a football oriented time enabled hybrid game, a game time clock 330 counts down the amount of time in the game (for example four quarters of 15 game time minutes each.) The rate at which units of time are output by this game time clock is affected in part by player input. players can choose to attenuate or accelerate the rate at which the game time clock 330 emits pulses (units of time) and in some embodiments this may be accompanied by an alteration in the amount of RC that is gambled as a function (at least in part) of the game time clock 330 output.

In many embodiments, the game time clock (such as game time clock 310 or 330) or real time clock 300 output is input to a display logic (such as display logic 350, 352 or 356) that, as part of the ESE or GWE, conditions this output for display to the player. The display logic (such as display logic 350, 352 or 356) can perform mathematical (for example integrate, subtract, add) and/or logic functions on the clock output and display the results of these function(s) and/or convey this information to other subsystems within the GWE and/or ESE.

In numerous embodiments, players participating in a time enabled hybrid game operating with time as a trigger for gambling events, may decide how much time to purchase, using RC. The time in question can be real time and/or game time. The purchases can be made at the onset of game play and/or during game play.

Figure 4:
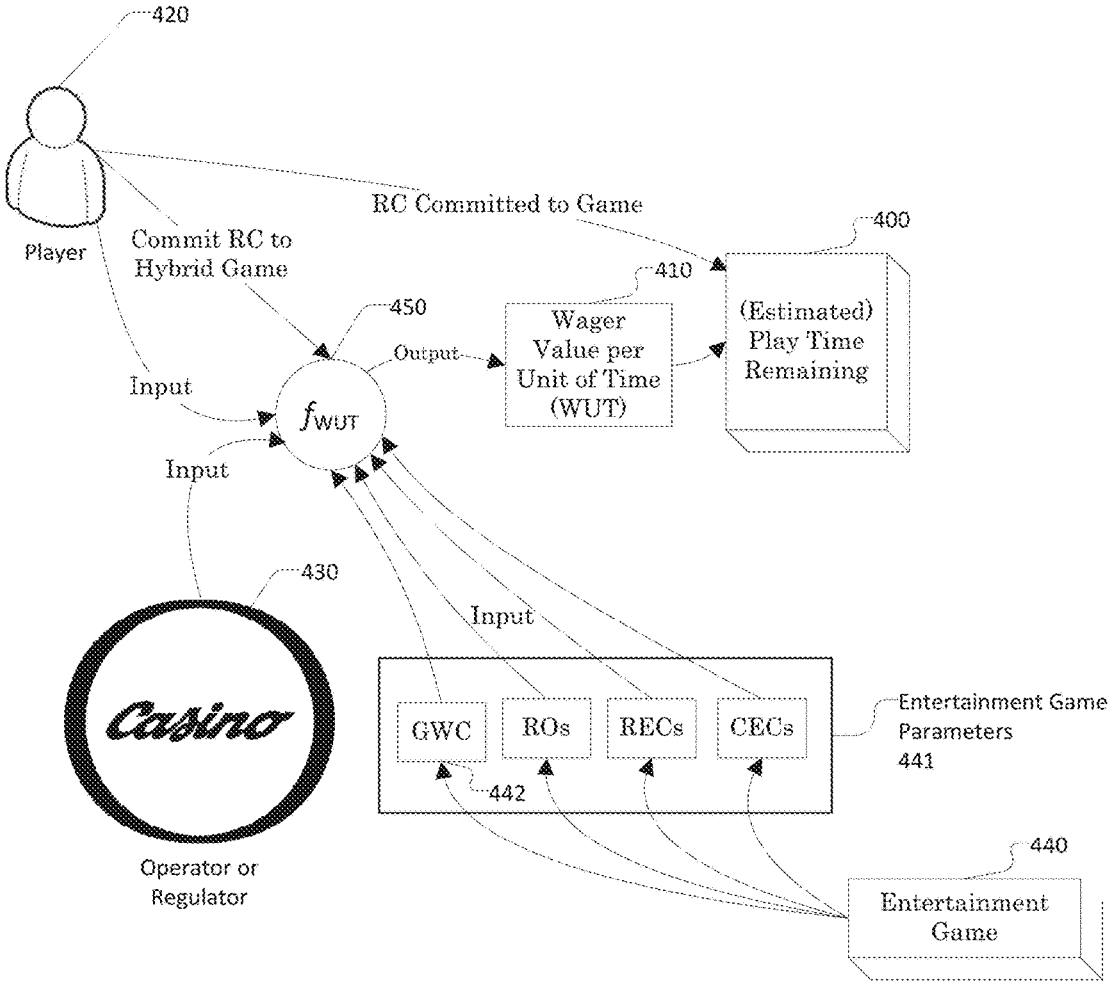
FIG. 4 is a flow chart illustrating another process of a time enabled hybrid game in accordance with an embodiment of the invention.

FIG. 4 is a flow chart illustrating another process of a time enabled hybrid game in accordance with an embodiment of the invention. In various embodiments, to establish the amount of play time remaining 400, a wager value per unit of time 410 (WUT) is first established as a function of player 420 input (for example, they may have an element of choice), as a function of casino 430 input (including but not limited to business conditions, casino rules and logic, player status vis-à-vis a player's club or other factors including player skill, etc.), and parameters 441. The parameters may include required objects (RO) that are specific game world objects necessary within the game world for a particular actionable element to be acted upon. For instance, a specific key needed to open a door in some embodiments. The parameters may also include a required environmental condition (REC) that represents a game state necessary within the game world for an action to be completed. For instance, daylight might be required to walk through woods in a particular embodiment of a time enabled hybrid game. The parameters may also include one or more controlled entity characteristics (CECs) such as a status or attribute necessary for a controlled entity within the game world to act upon a specified actionable element. In a particular embodiment, a controlled entity may be required to have full health points before entering battle. The parameters may also include an amount of game world credit (GWC) 442. As RC is entered into the machine, the amount of play time remaining 400 is established as a function 450 of WUT 410.

In various embodiments, WUT 410 need not be constant throughout time enabled hybrid game play. It may be a constant, but it may also vary as a function of the aforementioned during game play. The amount of game time remaining 400 can also change, therefore, as WUT 410 changes.

In various embodiments, a time enabled hybrid game may include more than one WUT 410. There can be one WUT 410 dedicated to each type of time in use in the game, or a single WUT 410 can apply to a multitude of real time clocks and/or game time clocks.

In some embodiments, where there are multiple WUTs 410, or WUT 410 changes over time, the amount of play time remaining 400 may be an estimate, rather than a declarative statement as to how much game play (in real time and/or game time) remains. If WUT 410 changes, for example, from 2 RC per decade (as in a civilization building game) to 4 RC per decade, the amount of play time remaining 400 will drop by ½. As noted subsequently, gambling game wins can also augment the amount of play time remaining 400.

In many embodiments, the GWE and/or ESE inform the player as to the value of WUT 410 and play time remaining 400 through the GW Display.

In numerous embodiments, the WUT 410 is not a function of real time. It can be a function, in whole or in part, of elapsed game time, but its value is not a function of elapsed time.

In some embodiments, a time enabled hybrid game may use a real time clock to trigger gambling events, for example, a trivia game. In this example, WUT 410 is a function of player 420 skill (the higher the skill, the higher WUT 410), the number of competing players 420 (the more players 420 in the game the lower WUT 410), the difficulty of the trivia question (the more difficult, the higher the WUT 410), and the player's 420 player club status (the more status the lower the WUT 410).

In an embodiment, where an adventure game takes place on the planet "Hectarian" and where a game time clock outputs a pulse each "Hectarian Quadro", where a Hectarian Quadro represents a single rotation of the planet Hectarian around its star, the WUT 410 corresponds to the amount of GWC 442 accumulated by the player during the Hectarian Quadro, which in turn is a measure of the amount of successful combat missions undertaken by the player's 420 CE during this period.

In another embodiment, where a time enabled hybrid game is used to implement an embodiment of a civilization building game set in ancient Greece, where the game time clock emits a pulse coincident with the passing of a decade in the game world, a decade being considered to have elapsed when a player 420 completes a specific set of actions related to game play (for example a migration phase, a battle phase and then a construction phase), the WUT 410 is a fixed amount set by the player 420 during a configuration phase at the onset of game play, whereby the range of available choices for WUT 410 (in terms of RC) are parameterized by the Casino 430.

In another embodiment, an adventure game has two modes of play, movement and combat. In movement mode, the game time clock emits a pulse (unit of time) each week of game time, as the CECs traverse varied terrain as part of a quest (such as a movement phase). When CECs are engaged in battle with monsters they encounter, the game time clock may emit a pulse (unit of time) for each minute (in game time not real time) of hand-to-hand combat. During movement phase, the WUT 410 is a function of the mobility of the player's CE. More mobile CEs have lower WUTs 410 for movement phase (for example 2 RC instead of 4 RC). In combat phase, WUT 410 is lower for those CEs with higher battle-related skills (for example 5 instead of 8 RC), and in this example WUT 410 for combat is always higher than WUT 410 for movement.

In another embodiment, where players' 420 CEs are black bears and the entertainment game consists of living the life of the bears, the WUT 410 is proportional to the weight of the bear, and therefore, to some extent, the age and experience of the bear (and the skill of the player 420 by extension.)

In another embodiment, in a football oriented time enabled hybrid game, where the game time clock counts down the amount of time in the game (such as four quarters of 15 game time minutes each) the WUT 410 is a function of the play called by the offense, and the roster of the player's 420 team in the game.

Figure 5:
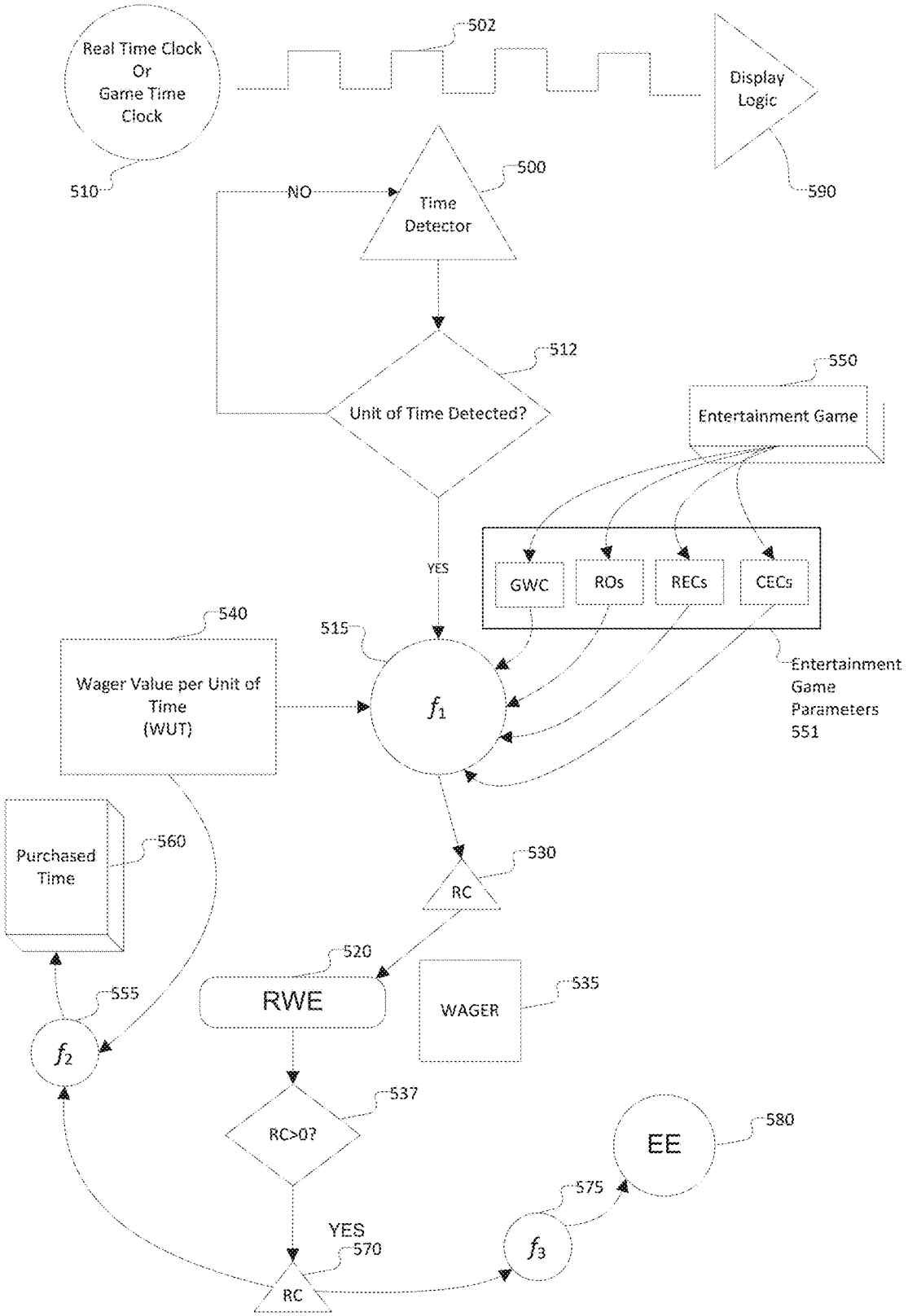
FIG. 5 is a flow chart illustrating another process of a time enabled hybrid game in accordance with an embodiment of the invention.

FIG. 5 is a flow chart illustrating another process of a time enabled hybrid game in accordance with an embodiment of the invention. In various embodiments, a bet is triggered in a time enabled hybrid game as follows. A time detector 500 monitors the output 502 of a clock 510. The clock 510 may be a real time clock or a game time clock. A single time detector 500 may monitor one or more such clocks 510 within a time enabled hybrid game.

In some embodiments, multiple time detectors 500 (and the other entities described in this diagram as well) can exist simultaneously within a time enabled hybrid game.

In various embodiments, once a unit of time is detected 512, a function f1 515 triggers a wager in the RWE 520 by (1) determining the amount of RC 530 to be committed to the wager 535, and then (2) communicating this to the RWE 520.

In various embodiments, the determination as to the amount of RC 530 to be committed to the gambling game is a function of the WUT 540. f1 515 may also take into account the state and/or change in state of the entertainment game 550 or entertainment game parameters 551.

In various embodiments, once the wager 535 takes place, if a winning result is achieved 537, RC 570 is returned to the player, and a function, f2 555, establishes how much (if any) additional time is to be accreted to the player's purchased time 560 variable. This too takes WUT 540, and by extension all its precedent inputs, as input.

In some embodiments, the amount of RC 570 generated also affects, via f3 575, the amount of EE 580 available to a player's controlled entity (CE) in the game. This functionality is present in implementations where EE 580, in addition to purchased time 560, is part of the time enabled hybrid game construct.

In various embodiments, f2 555 always returns zero, such that only f3 575 is active. This aspect of the invention relates to the case where a fixed amount of time (real or game) need not be purchased, but rather time is not a factor limiting game play, and acts solely as a trigger.

In many embodiments, the game clock 510 output is input to display logic 590 that, as part of the ESE or GWE, conditions this output for display to the player. The display logic 590 can perform mathematical (for example integrate, subtract, add) and/or logic functions on the clock output and display the results of these function(s) and/or convey this information to other subsystems within the GWE and/or ESE.

In an embodiment, a trivia game is implemented as a time enabled hybrid game that uses a real time clock to trigger gambling events. In such an embodiment, a virtual hourglass is shown on the game world display, via the display logic 590. When the virtual hourglass (which corresponds to a fixed amount of time, for example, 30 seconds) runs out of sand the function f1 515 determines how much RC 530 to commit to the gambling proposition within the RWE 520 as a function of the WUT 540 (which is not a function of real time) and whether the player answered the question correctly or not. If the gambling game returns a positive result, the player gains additional time to play (which corresponds in this example to additional turns) according to f2 555, and may also, depending upon the results of the gambling game, and possibly certain entertainment game variables, gain EE 580 according to f3 575, EE 580 in this example being "hints" that the player can access during game play, but which cause additional RC 530 to be committed to the gambling proposition.

In another embodiment, implementing an adventure game that takes place on the planet "Hectarian", and where a game time clock outputs a pulse each "Hectarian Quadro", and where a Hectarian Quadro represents a single rotation of the planet Hectarian around its star, f1 515 does not take any additional inputs beyond WUT 540, converting this into an amount of RC 530 according to a simple linear formula. In a particular embodiments, the equation is RC 530=b*WUT 540, where b is a positive integer.

In another embodiment, in a racing game that uses a real time clock, a gambling game is initiated by f1 515 when the amount of time elapsed since the last gambling event is 2 minutes or more AND the CE (a race car) crosses the starting line, completing a lap of the track. As shown in this example, not only may a bet be triggered as a function of real or game time, but the triggering of a bet may be conditioned upon one or both of these but also the state or change of state of other entertainment game parameters 551.

Figure 6:
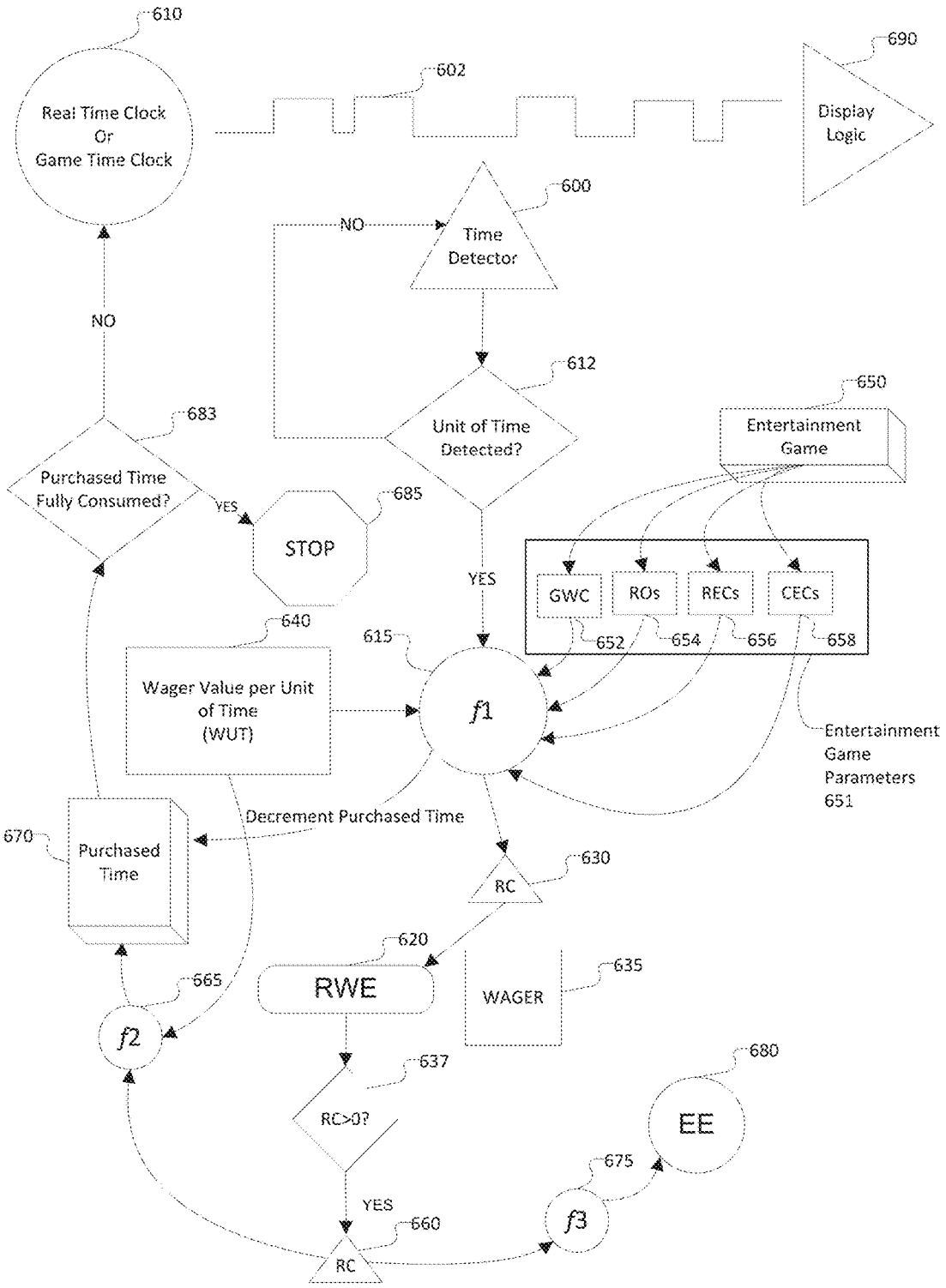
FIG. 6 is a flow chart illustrating another process of a time enabled hybrid game in accordance with an embodiment of the invention.

FIG. 6 is a flow chart illustrating another process of a time enabled hybrid game in accordance with an embodiment of the invention. In various embodiments, a bet is triggered in a time enabled hybrid game as follows. A time detector 600 monitors the output 602 of a clock 610. The clock 610 may be a real time clock or a game time clock. The single time detector 600 may monitor one or more such clocks 610 within a time enabled hybrid game.

In some embodiments, multiple time detectors 600 (and the other entities described in this diagram as well) can exist simultaneously within a time enabled hybrid game.

In various embodiments, once a unit of time is detected 612, a function f1 615 triggers a wager in the RWE 620 by (1) determining the amount of RC 630 to be committed to the wager 635, and then (2) communicating this to the RWE 620.

In numerous embodiments, the determination as to the amount of RC 630 to be committed to the gambling game is a function of the WUT 640. f1 615 can also take into account the state of the entertainment game 650 or entertainment game parameters 651 and/or a change in the state of the entertainment game 650.

In various embodiments, once the wager 635 takes place, if a winning result is achieved 637, RC 660 is returned to the player, and a function, f2 665, establishes how much (if any) additional time is to be accreted to the player's purchased time 670 variable. This too takes WUT 640, and by extension all its precedent inputs, as input.

In numerous embodiments, the amount of RC 660 generated also affects, via f3 675, the amount of EE 680 available to a player's CE in the game. This functionality is present in implementations where EE 680, in addition to purchased time 670, is part of the time enabled hybrid game construct. Alternately, the element labeled EE 680 could be replaced with any variable within the entertainment game 650, including entertainment game parameters 651, such as GWC 652, ROs 654, RECs 656, CECs 658, etc.

In some embodiments, f2 665 always returns zero, such that only f3 675 is active.

In various embodiments, the clock(s) 610 (real time and/or game time clock(s)) are only operational so long as purchased time 670 is available. When purchased time is depleted or fully consumed 683, the stop function 685 may be invoked. This can cause the game to pause, requesting additional RC 630 to be inserted, it can shift the game to a "free play" mode for an indefinite or limited amount of time, it can initiate a different bonus game, or any other pre-programmed action can be taken in concert with casino policy in the context of variables available to the time enabled hybrid game.

In many embodiments, the game clock 610 output 602 is input to display logic 690 that, as part of the ESE or GWE, conditions this output for display to the player. The display logic 690 can perform mathematical (for example integrate, subtract, add) and/or logic functions on the clock output and display the results of these function(s) and/or convey this information to other subsystems within the GWE and/or ESE.

Figure 7:
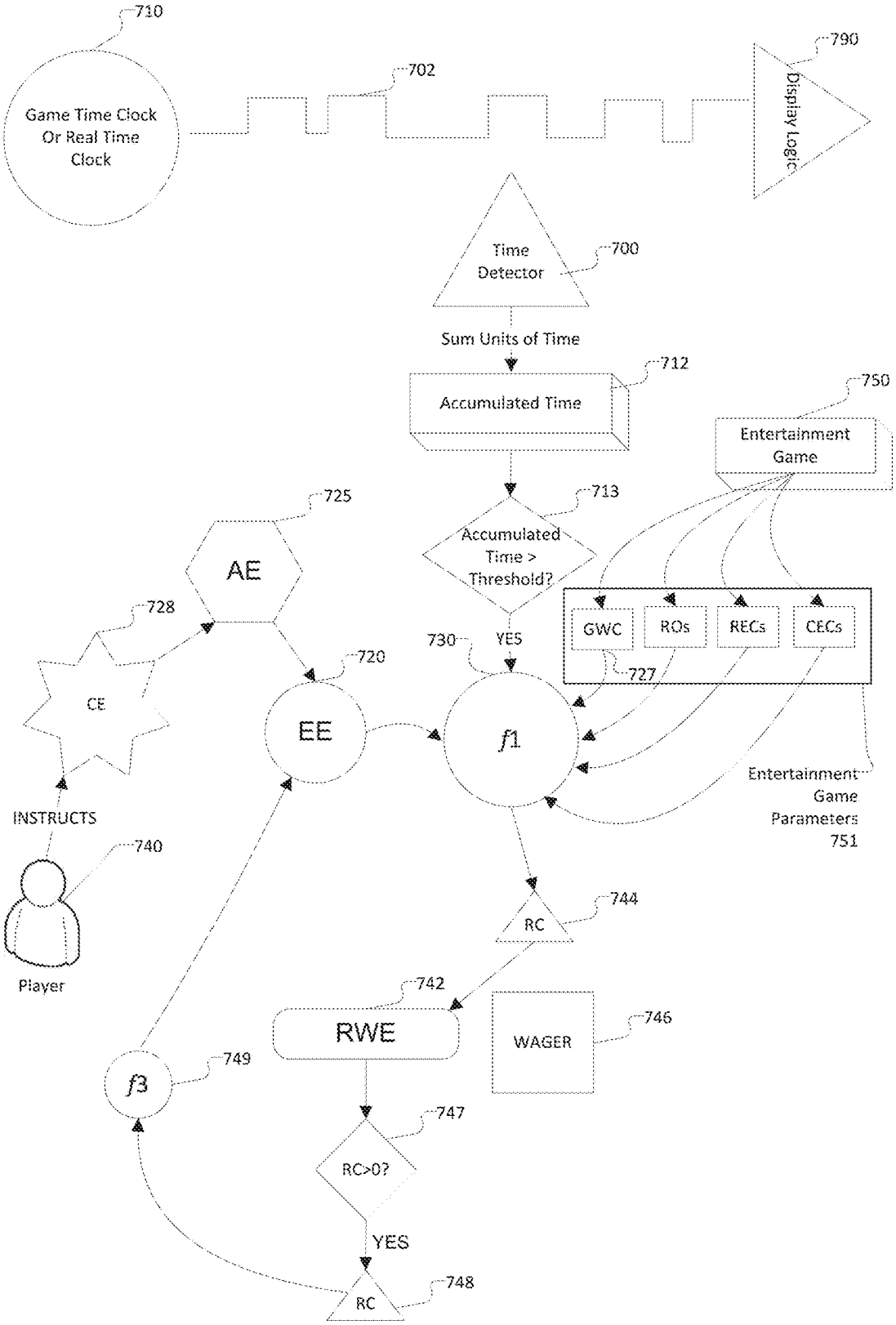
FIG. 7 is a flow chart illustrating another process of a time enabled hybrid game in accordance with an embodiment of the invention.

FIG. 7 is a flow chart illustrating another process of a time enabled hybrid game in accordance with an embodiment of the invention. In various embodiments of the invention, a time enabled hybrid game can be configured so that bets are triggered as a function of a specified amount of real time or game time having elapsed. The time detector 700 monitors the output 702 of the clock 710 (real time clock or game time clock). When the specified amount of accumulated time 712 is greater than the set threshold 713, a bet is triggered. The bet being a function of EE 720 as previously described for time enabled hybrid games. Likewise, any of the other AE 725, CE 728 or combinatorial implementations previously described could likewise be invoked by the accumulation of a specific amount of game time or real time.

In various embodiments, once the accumulated time 712 is greater than the set threshold 713, the function f1 730 triggers a wager 746 in the RWE 742 by (1) determining the amount of RC 744 to be committed to the wager 746, and then (2) communicating this to the RWE 742.

In numerous embodiments, f1 730 can also take into account the state, or changes in the state of the entertainment game 750 or the entertainment game parameters 751.

In various embodiments, once the wager takes place, if a winning result is achieved 747, RC 748 is returned to the player.

In numerous embodiments, the amount of RC 748 generated also affects, via f3 749, the amount of EE 720 available to a player's 740 CE 728 in the game. This functionality is present in implementations where EE 720 is part of the time enabled hybrid game construct. Alternately, the element labeled EE 720 could be replaced with any variable within the entertainment game 750, including but not limited to AE 725 or entertainment game parameters 751.

In some embodiments, the game time or real time may or may not have to be purchased by a player 740 in advance using RC 744, GWC 727 or other forms of currency. In cases where the game time or real time is not purchased they may or may not be depleted and may or may not be limited.

In numerous embodiments, the amount of accumulated time 712 is not an argument to f1 730, but enables f1 730 to operate on EE 720. f1 730 may take as arguments, parameters 751 related to the entertainment game 750, either to affect the amount of RC 725 committed to the gambling game, and/or to affect pay tables, and/or solely as conditions to be met before f1 730 can operate on EE 720 and establish the amount of RC 744 to be committed to the gambling game.

In many embodiments, the game clock 710 output 702 is input to display logic 790 that, as part of the ESE or GWE, conditions this output for display to the player. The display logic 790 can perform mathematical (for example integrate, subtract, add) and/or logic functions on the clock output and display the results of these function(s) and/or convey this information to other subsystems within the GWE and/or ESE.

Figure 8:
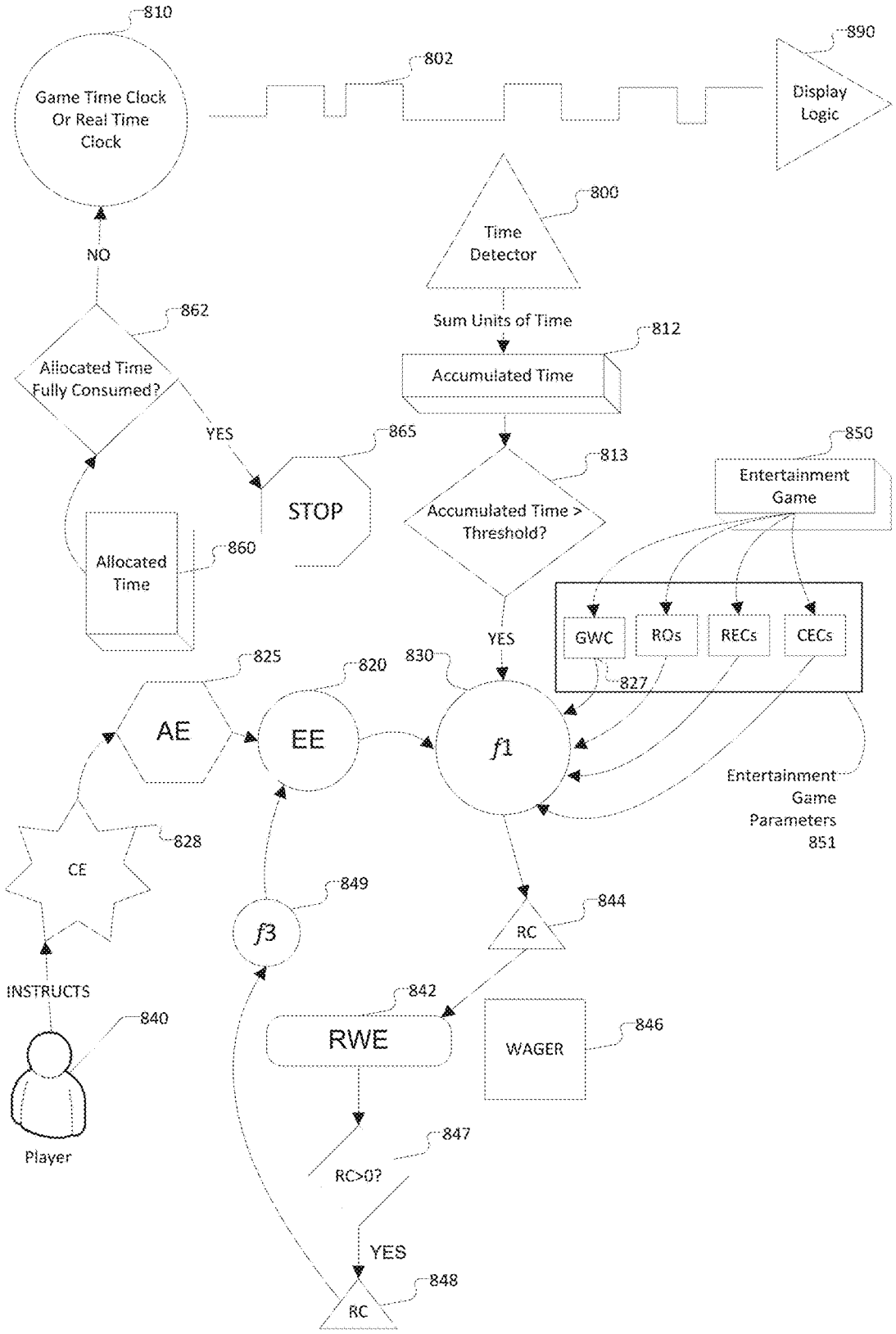
FIG. 8 is a flow chart illustrating another process of a time enabled hybrid game in accordance with an embodiment of the invention.

FIG. 8 is a flow chart illustrating another process of a time enabled hybrid game in accordance with an embodiment of the invention. In various embodiments of the invention, a time enabled hybrid game can be configured so that bets are triggered as a function of a specified amount of real time or game time having elapsed. The time detector 800 monitors the output 802 of the clock 810 (real time clock or game time clock). When the specified amount of accumulated time 812 is greater than the set threshold 813, a bet is triggered. The bet being a function of EE 820 as previously described for time enabled hybrid games. Likewise, any of the other AE 825, CE 828 or combinatorial implementations previously described could likewise be invoked by the accumulation of a specific amount of game time or real time.

In various embodiments, once the accumulated time 812 is greater than the set threshold 813, the function f1 830 triggers a wager in the RWE 842 by (1) determining the amount of RC 844 to be committed to the wager 846, and then (2) communicating this to the RWE 842.

In numerous embodiments, f1 830 can also take into account the state and/or a change in the state of the entertainment game 850 or the entertainment game parameters 851.

In numerous embodiments, when a wager is won 847, the amount of RC 848 generated also affects, via f3 849, the amount of EE 820 available to a player's 840 CE 828 in the game. This functionality is present in implementations where EE 820 is part of the time enabled hybrid game construct. Alternately, the element labeled EE 820 could be replaced with any variable within the entertainment game 850, including entertainment game parameters 851.

In some embodiments, the game time or real time may or may not have to be purchased by a player 840 in advance using RC 844, GWC 827 or other forms of currency. In cases where the game time or real time is not purchased they may or may not be depleted and may or may not be limited. When limited, the game is undertaken in the context of allocated time 860. Once the allocated time 860 is fully depleted or consumed 862, the stop function 865 is called. Upon stop 865, the game may be over, and the player 840, if they want to continue, may have to begin a new game session, or the player 840 may be required to commit additional funds (which in the example depicted by this diagram would link to EE 820) to continue the same game session, as an example.

In some embodiments, the amount of time elapsed is not an argument to f1 830, but enables f1 830 to operate on EE 820. f1 830 may take as argument variables related to the entertainment game, either to affect the amount of RC 844 committed to the gambling game, and/or to affect pay tables, and/or solely as conditions to be met before f1 830 can operate on EE 820 and establish the amount of RC 844 to be committed to the gambling game.

In many embodiments, the game clock 810 output 802 is input to display logic 890 that, as part of the ESE or GWE, conditions this output for display to the player. The display logic 890 can perform mathematical (for example integrate, subtract, add) and/or logic functions on the clock output and display the results of these function(s) and/or convey this information to other subsystems within the GWE and/or ESE.

Figure 9A:
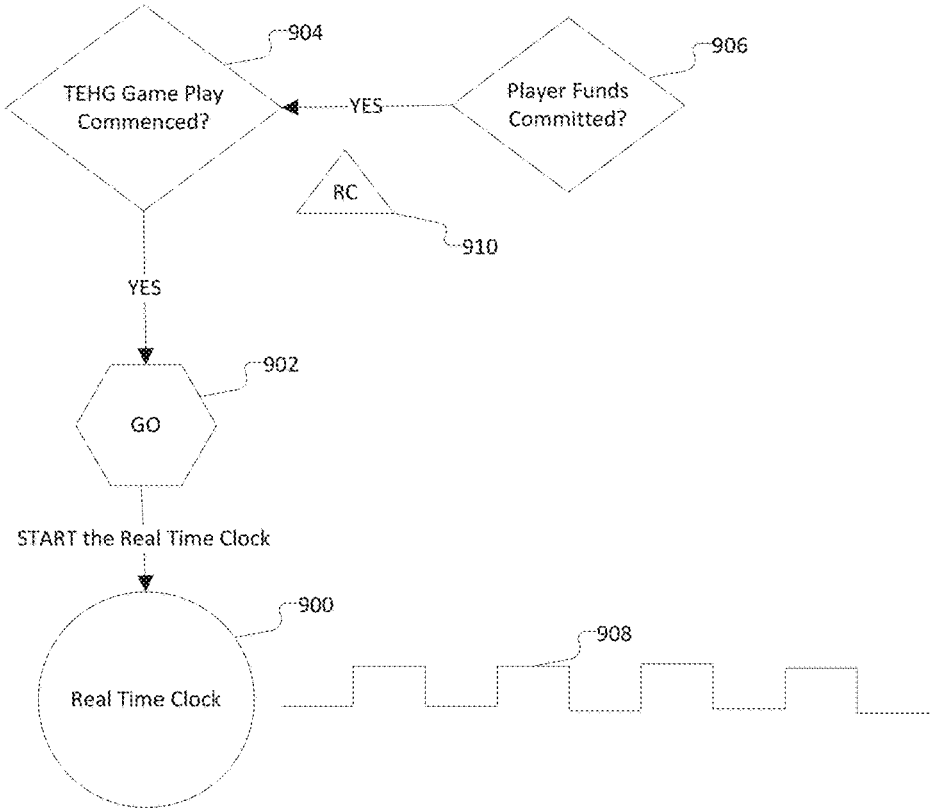
FIG. 9A is a flow chart illustrating another process of a time enabled hybrid game in accordance with an embodiment of the invention.

FIG. 9A is a flow chart illustrating another process of a time enabled hybrid game in accordance with an embodiment of the invention. In various embodiments, the output of a clock in a time enabled hybrid game is not commenced until credits are added to the time enabled hybrid game. In such a time enabled hybrid game, the output of a clock 900 commences, via the go function 902, when the time enabled hybrid game game play has commenced 904. A player commits funds 906 in the form RC 910 or another acceptable form of real or virtual currency to the game, makes game related configuration choices, and ultimately commences game play 904. The commencement of game play starts the clock 900 output of pulses 908.

Figure 9B:
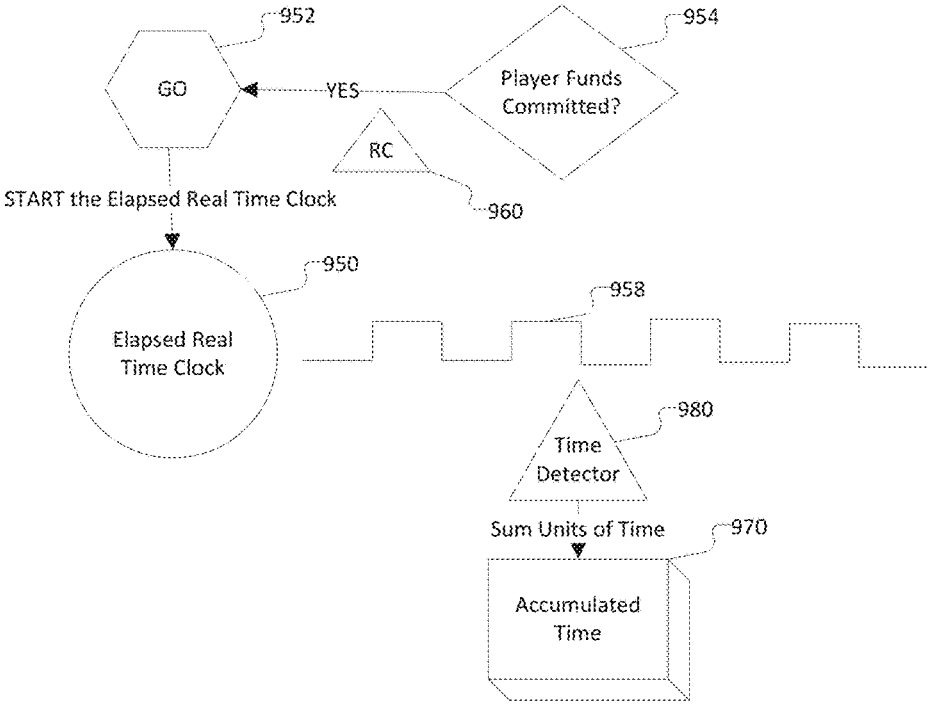
FIG. 9B is a flow chart illustrating another process of a time enabled hybrid game in accordance with an embodiment of the invention.

FIG. 9B is a flow chart illustrating another process of a time enabled hybrid game in accordance with an embodiment of the invention. In various embodiments, where the clock is an elapsed time clock 950. The elapsed time clock 950 begins to operate, via the go function as soon as the player commits funds 954 in the form of RC 960 or another acceptable form of currency, to the game in question (or when using an elapsed time clock that spans multiple game types, to that elapsed time clock 950). The output 958 of the elapsed time clock 950 is monitored by the time detector 980. The time monitored by the time detector is summed as accumulated time 970. A player's bets within a given time enabled hybrid game will be a function of the amount of accumulated time 970 elapsed (whether playing a game or not), as monitored by the time detector 980, since the last elapsed time triggered gambling event or since the elapsed time clock commenced operation.

In an embodiment, a Scrabble® game is implemented as a time enabled hybrid game, with an elapsed time clock. In this example, a player commits $100 to an elapsed time clock 950 linked exclusively to a time enabled hybrid game of Scrabble® to buy unlimited game play over the next 100 hours. The wager value per unit of time is $1/hour of elapsed time. The player then plays the time enabled hybrid game version of Scrabble® for 10 straight hours. During this period ten bets of $1 each were committed to the game. The player then sleeps for four hours. No bets are placed during this period. The player then sits back down at the Scrabble® time enabled hybrid game. After one hour of play, a bet of $5 is placed ($4 for each of the hours the player was sleeping, plus $1 for the hour played), and so on.

Figure 10:
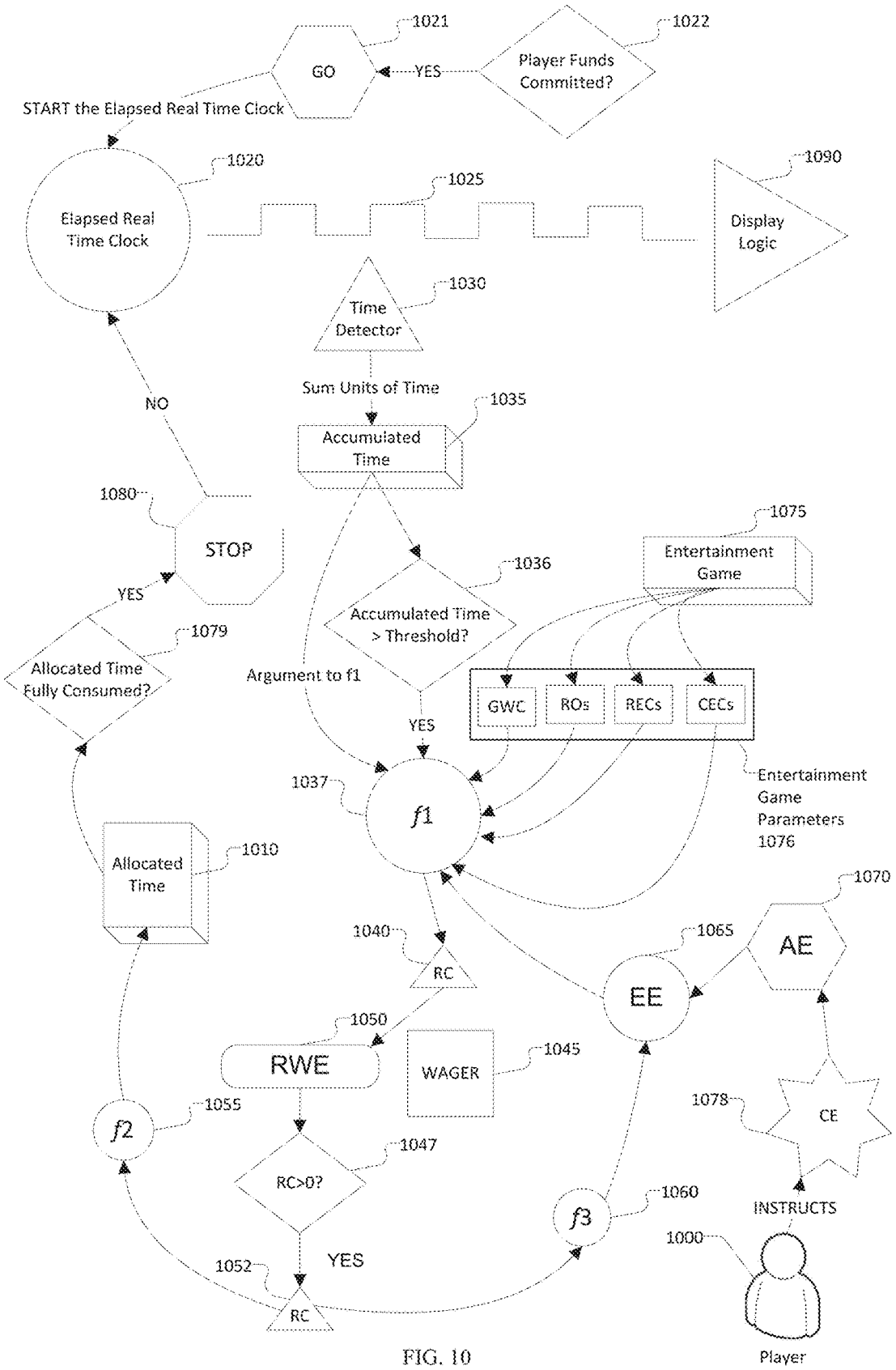
FIG. 10 is a flow chart illustrating another process of a time enabled hybrid game in accordance with an embodiment of the invention.

FIG. 10 is a flow chart illustrating another process of a time enabled hybrid game in accordance with an embodiment of the invention. In various embodiments, a player 1000 is assigned a specific amount of allocated time 1010, which may or may not have been purchased. This represents the total period of time (whether the player is playing the time enabled hybrid game or not) that the game will be accessible to the player. The elapsed time clock 1020 begins to operate (via the GO function 1021, as soon as the player 1000 commits funds 1022) to the game. If allocated time 1010 is not depleted, the elapsed time clock 1020 continues to output 1025 units of time. These are summed by the time detector 1030 as accumulated time 1035. When the player 1000 is active in the time enabled hybrid game, a wager is triggered, when the accumulated time is greater than the threshold 1036. The accumulated time 1035, along with other arguments, which may include the entertainment game 1075 or entertainment game parameters 1076, via function f1 1037 dictates the amount of RC 1040 committed to the gambling wager 1045 in the RWE 1050.

In numerous embodiments, when a wager is won 1047, the RC 1052 output of the gambling game, via f2 1055 and f3 1060 affects the amount of allocated time 1010 and EE 1065 respectively, available to the player 1000.

In some embodiments, one of these feedback loops (such as that through f2 1055 or through f3 1060) may not be present.

In various embodiments, the wager 1045 is a function of elapsed time, not solely the amount of time that the player is engaged directly with the time enabled hybrid game itself.

In some embodiments, the EE 1065-AE 1070 chain, available to the player's 1000 CE 1078, can be replaced by any of those previously disclosed (such as, EE 1065 only, AE 1070 only, AE 1070 to EE 1065, etc.).

In various embodiments, when limited, the game is undertaken in the context of allocated time 1010. Once the allocated time 1010 is fully consumed 1079, the stop function 1080 may be called. Upon stop 1080, the game may be over, and the player 1000, if they want to continue, may have to begin a new game session, or the player 1000 may be required to commit additional funds 1022 to continue the same game session, or begin a new game session, for example.

In many embodiments, the game clock 1020 output 1025 is input to display logic 1090 that, as part of the ESE or GWE, conditions this output for display to the player. The display logic 1090 can perform mathematical (for example integrate, subtract, add) and/or logic functions on the clock output and display the results of these function(s) and/or convey this information to other subsystems within the GWE and/or ESE.

Figure 11:
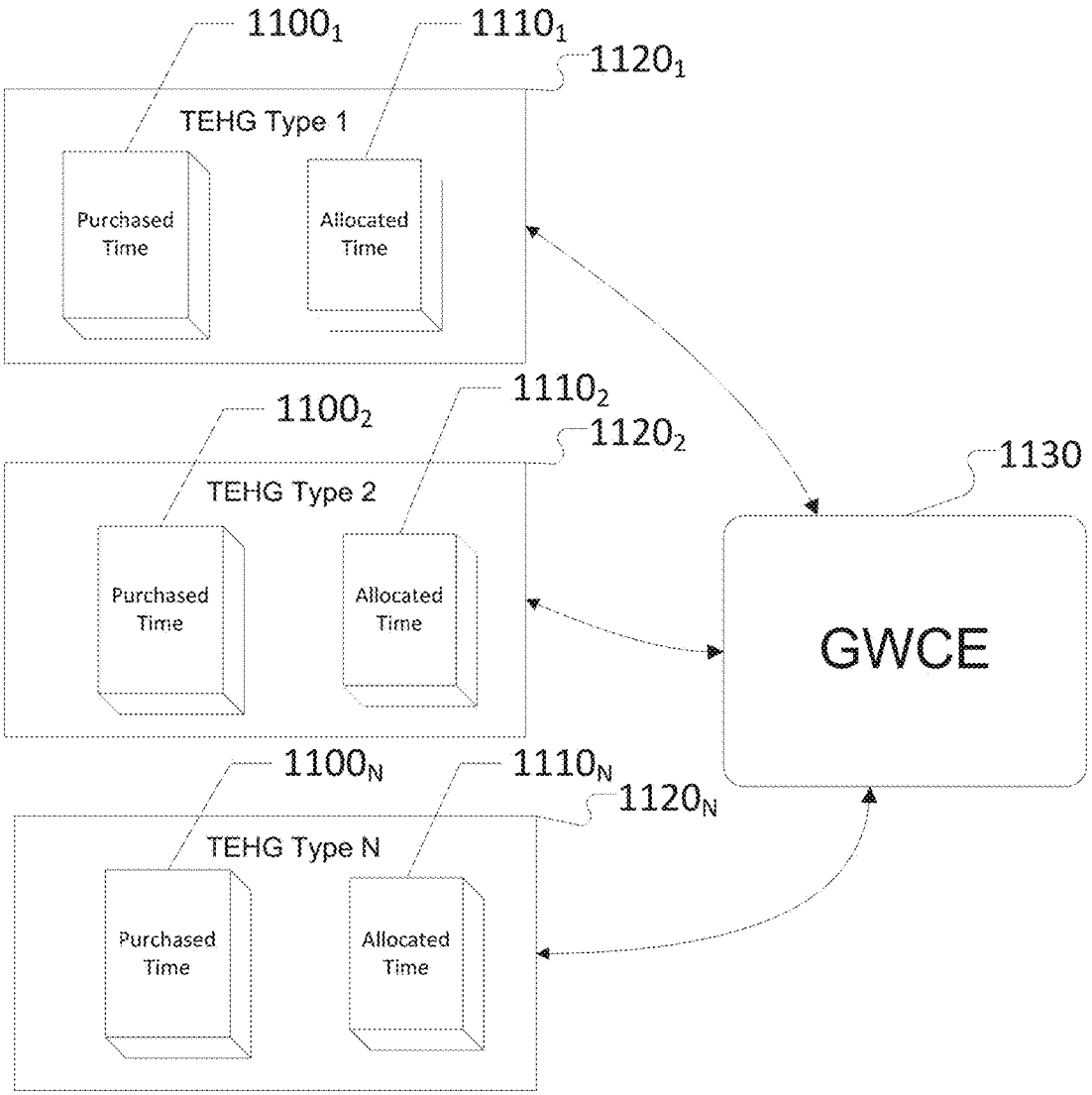
FIG. 11 is a flow chart illustrating another process of a time enabled hybrid game in accordance with an embodiment of the invention.

FIG. 11 is a flow chart illustrating another process of a time enabled hybrid game in accordance with an embodiment of the invention. In various embodiments, purchased time 1100 or allocated time 1110 (whether real time or game time) can be manipulated, exchanged and otherwise managed by a local or networked game world currency exchange 1130 (GWCE) in a similar manner that game world currency is. The diagram is meant to convey that the specific nature of time in the context of any given type of time enabled hybrid game 1120 can be exchanged via the GWCE 1130 construct for other types of time, and/or game world currency or universal game world currency. This invention also subsumes the concept of universal time, such that in embodiments where operators want to keep the exchange of time independent of the exchange of game world currency, a completely parallel system, again using the GWCE 1130 construct, can be established, operating solely on various types of time from various types of time enabled hybrid games 1120.

Figure 12:
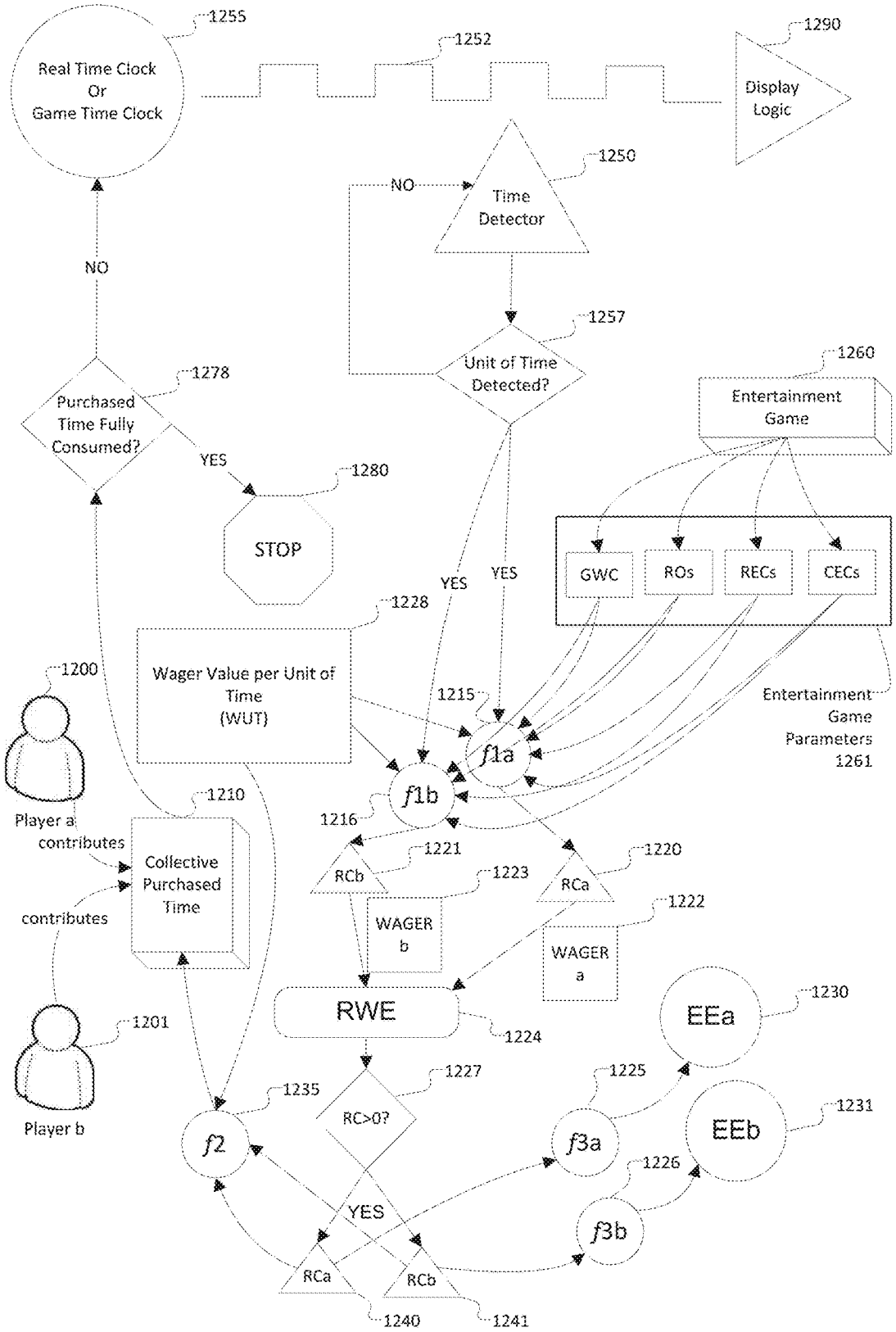
FIG. 12 is a flow chart illustrating another process of a time enabled hybrid game in accordance with an embodiment of the invention.

FIG. 12 is a flow chart illustrating another process of a time enabled hybrid game in accordance with an embodiment of the invention. In various embodiments, two or more players, such as 1200 and 1201, may contribute funds (or time itself through a GWCE based function) to a collective pool of time (collective purchased time 1210). While the flow chart shows this as collective purchased time 1210 it could also be collective allocated time, which was not purchased, or which was purchased by one or more of the players 1200 and 1201 but not purchased by one or more of the other players 1200 and 1201.

In various embodiments, a bet is triggered in a multiplayer time enabled hybrid game as follows. A time detector 1250 monitors the output 1252 of a clock 1255. The clock 1255 may be a real time clock or a game time clock. A single time detector 1250 may monitor one or more such clocks 1255 within a time enabled hybrid game.

In various embodiments, once a unit of time is detected 1257, the functions f1*a* 1215 and f1*b* 1216 trigger one or more wagers, such as wager a 1222 and wager b 1223, in the RWE 1224 by (1) determining the amount of RCa 1240 to be committed to wager a 1222 and RCb 1241 to be committed to wager b 1223, and then (2) communicating this to the RWE 1224.

In various embodiments, the determination as to the amount of RCa 1240 and RCb 1241 to be committed to the gambling game is a function of the WUT 1228. f1*a* 1215 and f1*b* 1216 may also take into account the state and/or change in state of the entertainment game 1260 or entertainment game parameters 1261.

In some embodiments, the collective purchased time 1210 (CPT) is subsequently consumed and refilled as a function of the two or more players 1200 and 1201 playing the time enabled hybrid game. f1*a* 1215 and f1*b* 1216 establish the amount of RC 1220 and 1221 for player a 1200 and player b 1201 that is allocated to joint or independent gambling games. RCa 1220 and RCb 1221 may be separately accounted for or conjoined in a single, collective RC. The flow chart displays these as separate accounts, but in some embodiments, the RC may be a single pool in the game.

In various embodiments, once the one or more wagers 1222 and 1223 takes place, if a winning result is achieved 1227, RC 1227 is returned to the player, functions f3*a* 1225 and f3*b* 1226 dictate how much EEa 1230 and EEb 1231 is allocated, as a result of the gambling game result or results to the one or more players 1200 and 1201. In various embodiments, the case where separate EE is maintained for each player (EEa 1230 and EEb 1231) is subsumed, as well as embodiments where EE is collective, and only a single type of EE is maintained (refer to FIG. 13 for an embodiment where RC is ultimately divided between players at the end of the game as a function of an agreement between the players, based on the amount of RC contributed by each player, or other algorithms).

In various embodiments, in the case of a winning wager 1227, the function f2 1235 determines how much the collective purchased time 1210 (or allocated time) is augmented as a function of the amount of RCa 1240 and RCb 1241 generated by the gambling game.

In various embodiments, when limited, the game is undertaken in the context of allocated time or collective purchased time 1210. Once the allocated time is fully consumed 1278, the stop function 1280 is called. Upon stop 1280, the game may be over, and the one or more players 1200 and/or 1201, if they want to continue, may have to begin a new game session, or one or more of the players may be required to commit additional RC to continue the same game session, or begin a new game session, for example.

In many embodiments, the game clock 1255 output 1252 is input to display logic 1290 that, as part of the ESE or GWE, conditions this output for display to the player. The display logic 1290 can perform mathematical (for example integrate, subtract, add) and/or logic functions on the clock output and display the results of these function(s) and/or convey this information to other subsystems within the GWE and/or ESE.

In another embodiment, a number of players operate as a relay team in a "Pony Express" construct implemented as a time enabled hybrid game. The players contribute RC to the time enabled hybrid game and this purchases a specified amount of game time (for example days). The goal of the game is for the players to cross the West with an important communiqué as fast as possible. Game play commences when player a's CE departs the depot on his horse and heads West. As the CE progresses across the terrain he encounters various challenges (the need to find water, bandits, etc.) and seeks to overcome these challenges so he can reach the next depot, at which time player b's CE will take over the mission of riding a new horse towards the next stop on the trail, and so on, until either the collective purchased time is exhausted or the goal of the game is achieved. During game play, gambling is initiated as a function of the passage of game time. At the close of each day of "riding" within the game, bets are configured for the currently active player as a function of their in-entertainment game performance that day, the state of their CE, etc. Gambling game wins provide the rider with additional food and water for himself and his horse (EE) and augment the amount of game time available, and therefore the number of communiqués that the team of players will ultimately be able to deliver (thereby affecting their game world credit).

In this embodiment, EE acquired by a specific player's CE is not transferrable to subsequent players in the relay, but game time acquired as a function of gambling wins is accessible to all players. As before, the RC accumulated by each player (a, b, c, etc.) during their stage of the relay can be retained individually (as a function of the funds each contributed or another mechanism), pooled and divided equally, divided according to another player-agreed scheme, etc. In this pony express game, the game world credit (GWC) can either be for the team as a whole, for each individual player (based on their performance in the relay), or a combination of both.

In various embodiments, such as the pony express embodiment, f1*a* 1215 and f1*b* 1216 may not be active simultaneously, but rather serially, based on which player is engaged with the game (for example, carrying the communiqués) at that time. The same is true for f3*a* 1225 and f3*b* 1226.

In another embodiment, a time enabled hybrid game that may use cooperative play is a "Maze" adventure construct is provided. The players contribute RC to the time enabled hybrid game and this purchases a specified amount of game time (for example days). The goal of the game is for the group of players to transverse a maze as fast as possible. Game play commences when the group players' CEs enter the maze. As the CEs progress through the maze they encounter various challenges (obstacles, secret switches, enemies, etc.) and seek to overcome these challenges so they can reach the end, at which time they may enter a new maze, encounter more challenges and so on, until either the collective purchased time is exhausted or the goal of the game is achieved. During game play, gambling is initiated as a function of the passage of game time. Bets are configured for the individual player as a function of their in-entertainment game performance that day, the state of their CE, etc. Gambling game wins provide the player with additional ladders, hints, secret passages, for himself and his party (EE) and augment the amount of game time available, and therefore the speed that the team of players will ultimately be able to travel (thereby affecting their GWC).

In this embodiment, EE acquired by a specific player's CE may or may not be transferrable to other group members, but game time acquired as a function of gambling wins is accessible to all players. As before, the RC accumulated by each player (a, b, c, etc.) during their game play can be retained individually (as a function of the funds each contributed or another mechanism), pooled and divided equally, divided according to another player-agreed scheme, etc. In this pony express game, the GWC can either be for the team as a whole, for each individual player (based on their performance in the game), or a combination of both.

In various embodiments, such the maze example, f1*a* 1215 and f1*b* 1216 are active simultaneously, based on which players are in the group (traversing the maze) at that time. The same is true for f3*a* 1225 and f3*b* 1226.

In some embodiments, certain parts of time enabled hybrid game may only be accessible through cooperative play. Parts of the entertainment game may require multiple players working simultaneously, or only allow access if a certain player threshold is met. Additionally, some prizes, including but not limited to, GWC, RC, tournament entries, and lottery tickets may only be accessible to cooperative play.

Figure 13:
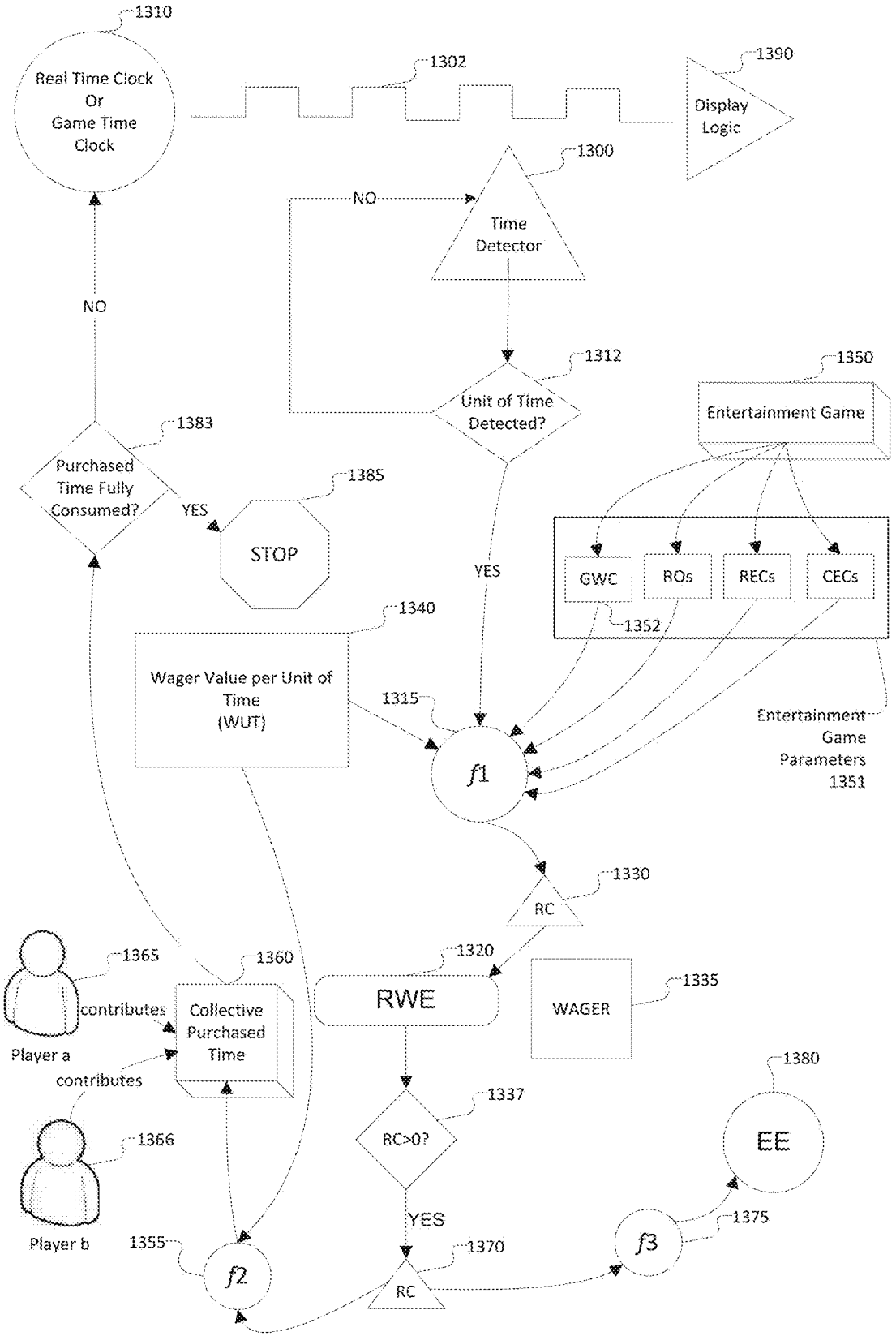
FIG. 13 is a flow chart illustrating another process of a time enabled hybrid game in accordance with an embodiment of the invention.

FIG. 13 is a flow chart illustrating another process of a time enabled hybrid game in accordance with an embodiment of the invention. In various embodiments, a time enabled hybrid game may be a collective purchased time enabled game. Here RC 1330 committed, RC 1370 won, EE 1380 and time 1360 are all collective. In many such embodiments, various mechanisms by which time 1360, RC 1370 won, EE 1380 are divided between the players at the conclusion of the game (or a player's exit from a game that has not yet concluded) may be implemented.

In various embodiments, the division of game resources or currencies, including but not limited to collective RC 1370, EE 1380, GWC 1352 and Time 1350, may be divided amongst the players (represented by player a 1365 and player b 1366) in proportion to the RC 1330 committed to the game by each player.

In some embodiments, a bet is triggered in a collective multi-player time enabled hybrid game as follows. A time detector 1300 monitors the output 1302 of a clock 1310. The clock 1310 may be a real time clock or a game time clock. A single time detector 1300 may monitor one or more such clocks 1310 within a time enabled hybrid game.

In some embodiments, multiple time detectors 1300 (and the other entities described in this diagram as well) can exist simultaneously within a time enabled hybrid game.

In various embodiments, once a unit of time is detected 1312, the function f1 1315 triggers a wager in the RWE 1320 by (1) determining the amount of collective RC 1330 to be committed to the collective wager 1335, and then (2) communicating this to the RWE 1320.

In various embodiments, the determination as to the amount of collective RC 1330 to be committed to the gambling game is a function of the WUT 1340. f1 1315 may also take into account the state and/or change in state of the entertainment game 1350 or entertainment game parameters 1351.

In various embodiments, once the wager 1335 takes place, if a winning result is achieved 1337, RC 1370 is returned to the collective players (represented by player a 1365 and player b 1366), and a function, f2 1355, establishes how much (if any) additional time is to be accreted to the player's collective purchased time 1360 variable. This too takes WUT 1340, and by extension all its precedent inputs, as input.

In other embodiments, the amount of collective RC 1370 generated also affects, via f3 1375, the amount of EE 1380 available to a player's controlled entity (CE) in the game. This functionality is present in implementations where EE 1380, in addition to collective purchased time 1360, is part of the time enabled hybrid game construct.

In other embodiments, f2 1355 always returns zero, such that only f3 1375 is active. Such embodiments relate to cases where a fixed amount of time (real or game) need not be purchased, but rather time is not a factor limiting game play, and acts solely as a trigger.

In various embodiments, when limited, the game is undertaken in the context of allocated time or collective purchased time 1360. Once the allocated time is fully consumed 1383, the stop function 1385 is called. Upon stop 1385, the game may be over, and player a 1365 and/or player b 1366, if they want to continue, may have to begin a new game session, or one or more of the players may be required to commit additional RC to continue the same game session, or begin a new game session, for example.

In many embodiments, the game clock 1310 output 1302 is input to display logic 1390 that, as part of the ESE or GWE, conditions this output for display to the player. The display logic 1390 can perform mathematical (for example integrate, subtract, add) and/or logic functions on the clock output and display the results of these function(s) and/or convey this information to other subsystems within the GWE and/or ESE.

Figure 14:
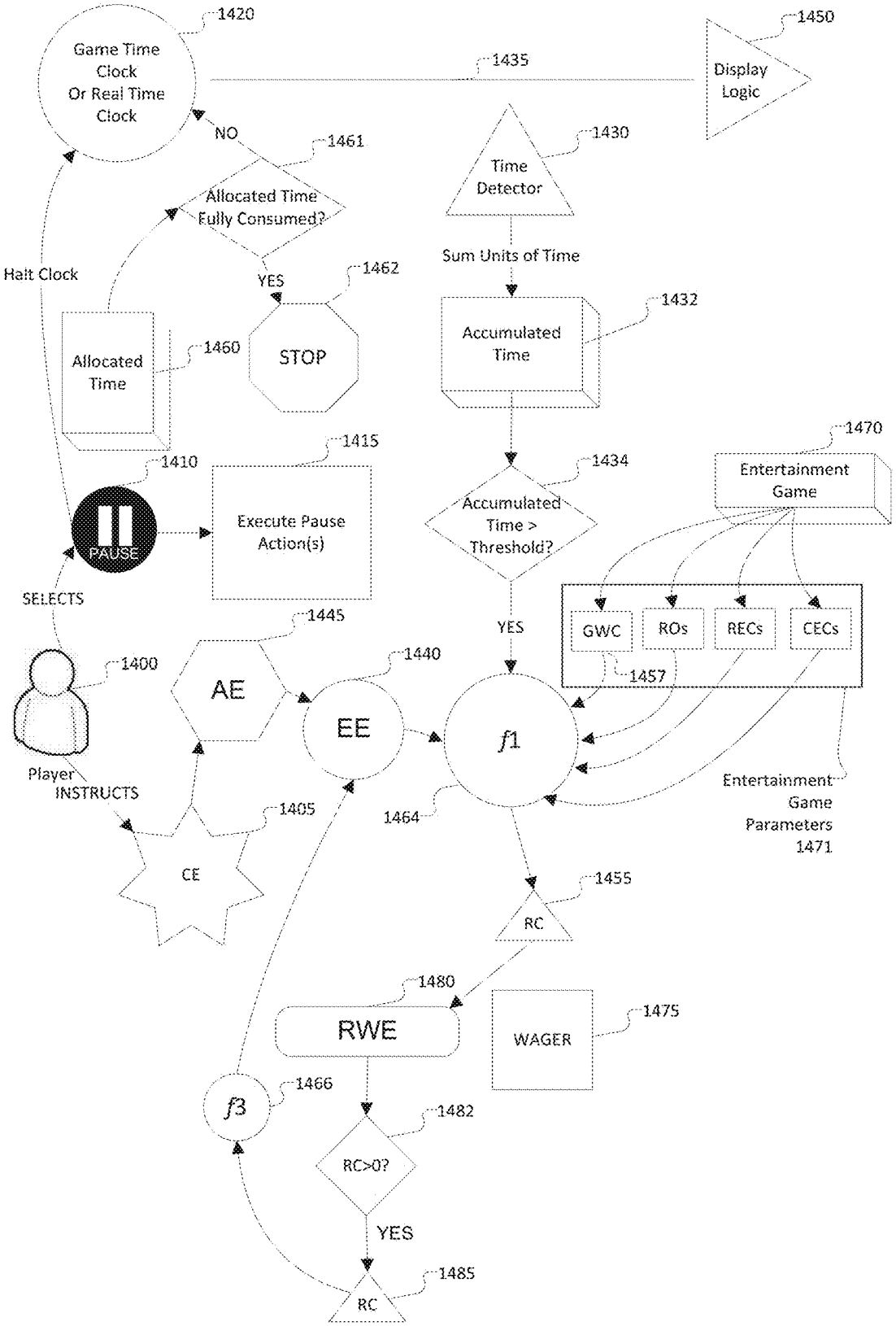
FIG. 14 is a flow chart illustrating another process of a time enabled hybrid game in accordance with an embodiment of the invention.

FIG. 14 is a flow chart illustrating another process of a time enabled hybrid game in accordance with an embodiment of the invention. In various embodiments, players 1400 (or CE 1405) may have access to a pause function 1410 through an ESE or GW user interface. When executed, the pause function 1410 does the following. It causes clock 1420 operation to cease. No more pulses are output by the clock 1420. As a result the time detector 1430 will not sense any additional units of time, and no additional time will be added to accumulated time 1432, no wagers will be triggered by the accumulated time threshold 1434. This is represented in the diagram by the flat-line output 1435 of the clock 1420.

In various embodiments, the pause function 1410 may cause one or more of the following actions, including but not limited to, to be executed 1415:

The game may be shifted to another mode of play, whereby EE 1440, AE 1445, CE 1405 or other triggering method of gambling (not time based) is evoked.

The game may be shifted to a non-gambling mode of play, whereby player 1400 may be able to play for free, or for a fee. The game may be continued directly in this mode from the current state, or a new game may need to be initiated. Both methods are supported.

The display logic 1450 communicates the game state to the player 1400 as described herein.

The player 1400 may be given a certain amount of real time to resume play, to cash out, or to choose another mode of game play.

The player 1400 may be charged a certain amount of RC 1455, GWC 1457, EE 1440, AE 1445 or other real-world or in-game currency to allow the pause state to persist for a certain amount of time. For example, a player 1400 could pay two credits (RC 1455) to allow the game to be paused for 10 minutes of real time and for the machine to be reserved for him to continue playing.

In some embodiments, while the pause function 1410 is active the following may occur:

Allocated time 1460 may or may not be consumed.

The stop function 1462 may or may not be invoked 1461.

CE 1405, AE 1445, EE 1440 may be frozen.

Functions f1 1464 and f3 1466, may not be invoked.

The entertainment game 1470 and entertainment game parameters 1471 may be frozen.

No new wager 1475 may be made.

No wagering 1475 or wagering wins 1482 may occur, and no RC 1485 will be generated by the RWE 1480.

In various embodiments, the pause function 1410 applies to time enabled hybrid games, but is also an aspect of the time enabled hybrid game construct generally, even if said time enabled hybrid game is not explicitly real time clock or game time clock driven. The difference being that in a time enabled hybrid game, the pause function 1410 halts the clock 1420, while in a time enabled hybrid game construct, this aspect of the functionality is not required.

This diagram illustrates the pause function 1410 in the context of one embodiment of a time enabled hybrid game. It should be understood that the pause function 1410 can be embedded in all manner of time enabled hybrid game varieties.

In many embodiments, the game clock 1420 output 1435 is input to display logic 1450 that, as part of the ESE or GWE, conditions this output for display to the player. The display logic 1450 can perform mathematical (for example integrate, subtract, add) and/or logic functions on the clock output and display the results of these function(s) and/or convey this information to other subsystems within the GWE and/or ESE.

Figure 15:
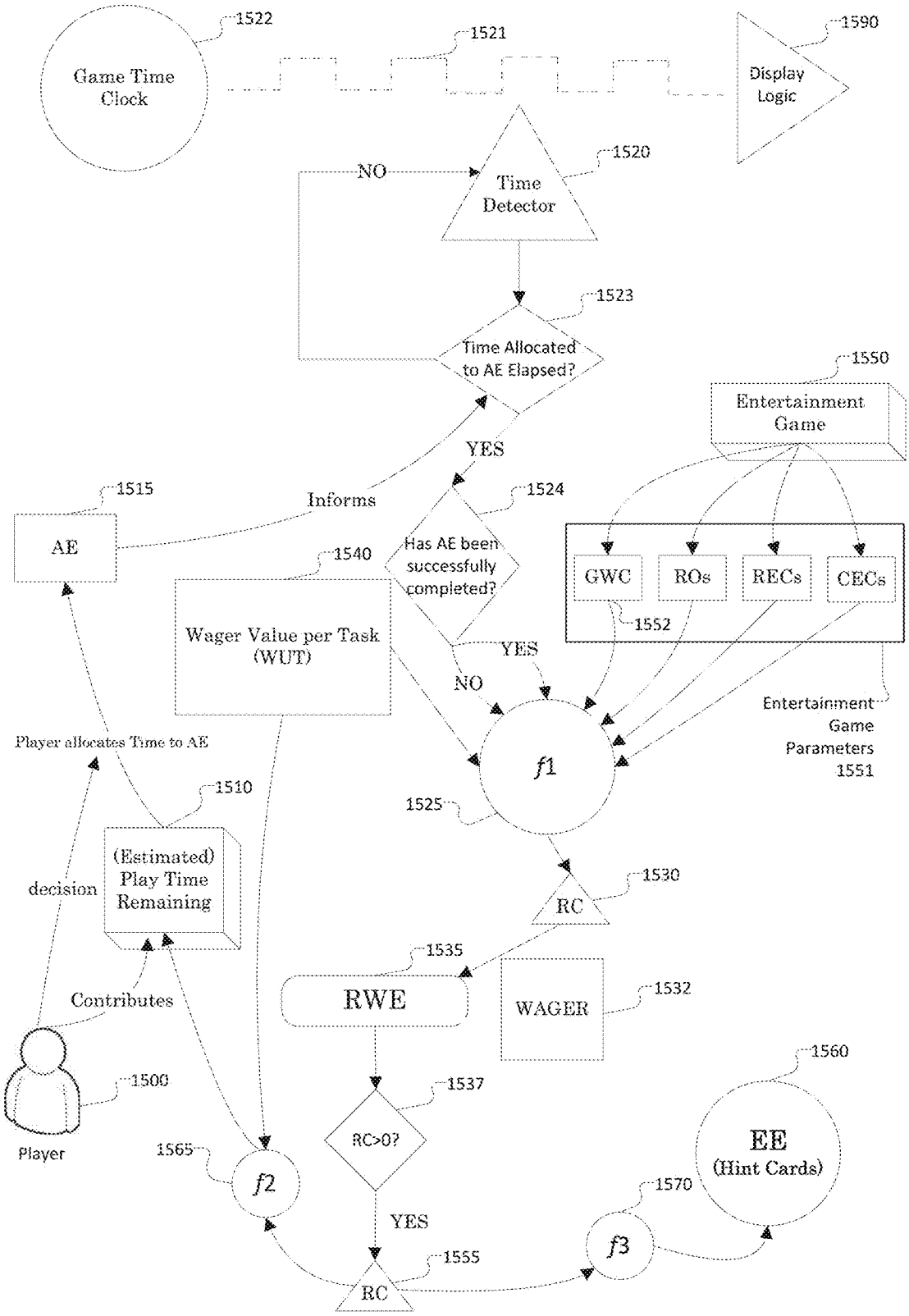
FIG. 15 is a flow chart illustrating another process of a time enabled hybrid game in accordance with an embodiment of the invention.

FIG. 15 is a flow chart illustrating another process of a time enabled hybrid game in accordance with an embodiment of the invention. In various embodiments, a player 1500 purchases time 1510 (real time or game time). The player also allocates how much time 1510 they want allocated to a particular type of AE 1515 (or AEs) within the game construct. This decision can be made at the onset of game play, at various times during game play, or both. During game play the time detector 1520 senses the progression of time, output 1521 from the game time clock 1522. When the amount of time allocated by the player 1500 to the AE 1515 has elapsed 1523 and the AE has been completed 1524, f1 1525 configures and triggers a gambling game.

In some embodiments, the function that configures the gambling game, f1 1525, establishes the amount of RC 1530 to be committed as a wager 1532 to the RWE 1535 by taking as input the WUT 1540, the amount of time elapsed, and potentially the entertainment game 1550 variables (for example whether the AE 1515 was successfully completed), including the entertainment game parameters 1551.

In various embodiments, once the wager 1532 takes place, if a winning result is achieved 1537, RC 1555 is returned to the player. The resulting gambling game outputs RC 1555, the amount of purchased time 1510 (or allocated time) and/or EE 1560 (or AE or CEE, etc.) is augmented according to f2 1565 and f3 1570 respectively.

In an embodiment, a time enabled hybrid game implementation of Name that Tune® is provided. The player 1500 purchases ten real time minutes for $1. The player 1500 then commences game play. First, the player 1500 selects to play the game at the "Intermediate" level, which establishes that each round of the game will contribute $0.05 to a gambling game and allow him 10 seconds to, "Name that tune." However, the player is able to add time to the AE (guessing the tune) at the rate of $0.01 per additional 5 seconds. The player would like thirty seconds to guess the tune. The round commences. The tune is played, and the real time clock is started. The time enabled hybrid game monitors the real time clock output until thirty seconds elapses. The player selects the name of the tune from a multiple choice list correctly within the thirty seconds. Function f1 1525 is then invoked. In this example, the player's answer is not an input to f1 1525 though it does affect his accumulation of GWC 1552. Because the player allocated 30 seconds to this AE 1515, f1 1525 commits $0.09 (RC 1530) to the gambling game. The gambling game returns a positive RC 1555 outcome of $0.12, which is then translated by f2 1565 into an increase of purchased time 1510.

Note that in various embodiments, the time enabled hybrid game has been described in all regards as affecting the amount of RC 1530 committed to the gambling game via f1 1525. In many of these embodiments, the elements that are inputs to f1 1525 are also able to be inputs to a function f4 (1690 of FIG. 16) that affects the pay table of the gambling game within the RWE (1695 of FIG. 16).

In another embodiment of a time enabled hybrid game implementation of Name that Tune®, the player 1500 contributes $1 of RC to the game. The player 1500 then commences game play. First, the player 1500 selects to play the game at the "Intermediate" level, which establishes that each round of the game will contribute $0.05 to a gambling game and allow him 10 seconds to, "Name that tune." Furthermore, the player is able to add time to the AE (guessing the tune) at the rate of $0.01 per additional 5 seconds. The player would like 35 seconds to guess the tune. The game also includes a face down deck of hint cards (EE 1560) for each round. At the onset of the game the card deck has two cards for each round. The cards include hints to help the player guess the name of the tune. During a round the player can select a card (so long as there are cards remaining) in exchange for committing an additional $0.10 to the gambling game (the hint cards are EE 1560 and the $0.10 is RC 1530).

In this embodiment, the round commences. The tune is played, and the real time clock is started. The time enabled hybrid game monitors the real time clock output until 35 seconds elapses or the player submits his answer. The player selects the name of the tune from a multiple choice list correctly in twenty two seconds having looked at the two clues available (leaving no clue cards). Function f1 1525 is then invoked. In this example, the player's answer is not an input to f1 1525, though it does affect his accumulation of GWC 1552. Because the player allocated 30 seconds to this AE 1515 and used two clue cards, f1 commits $0.30 (RC 1530) to the gambling game.

In some embodiments, the Function f4 (as described in FIG. 16) is also invoked. It alters the pay table based upon the fact that the user chose the "intermediate" level of game play, answered the question correctly, and did so in twenty two seconds (as opposed to 21 or 24 or 30, etc.). As a function of these factors the player might experience a more lucrative pay table. Function f4 (as described in FIG. 16) may also adjust the pay tables to reflect the use of the clue cards, and because two were used, the pay tables would be adjusted so as to be less lucrative, offsetting the player's 1500 speed at guessing the tune and the more difficult level of play.

In many such embodiments, the gambling game returns a positive 1537 RC 1555 outcome of $0.60, which is then translated by f2 into an increase of purchased time and f3 into additional hint cards (EE 1560) to be available to the player. In this example, the amount of RC 1555 considered to be affecting the increase in purchased time vs. the amount considered to be augmenting the amount of EE 1560 (hint cards) is proportional to the sources of funds (in this case, $0.20 of the RC contributed to the game was a function of hint card consumption) while the other $0.10 is allocated to the calculation run by f2. Function f3 is such that $0.05 of winnings provides an additional hint card, so in this example, the hint card stack is now 4 cards.

In various such embodiments, f2 increases purchased time at the rate of 5 seconds per $0.01 won ($0.10 of the $0.30 won is considered time related vs. clue card related), so the purchased time is increased by 55 seconds.

In many such embodiments, outputs of f2 and f3 are shown as one example. Here these formulae only considered the amount of RC won, rather than the total amount of RC returned. In other embodiments the total RC returned may factor into functions f1 and f2.

Figure 16:
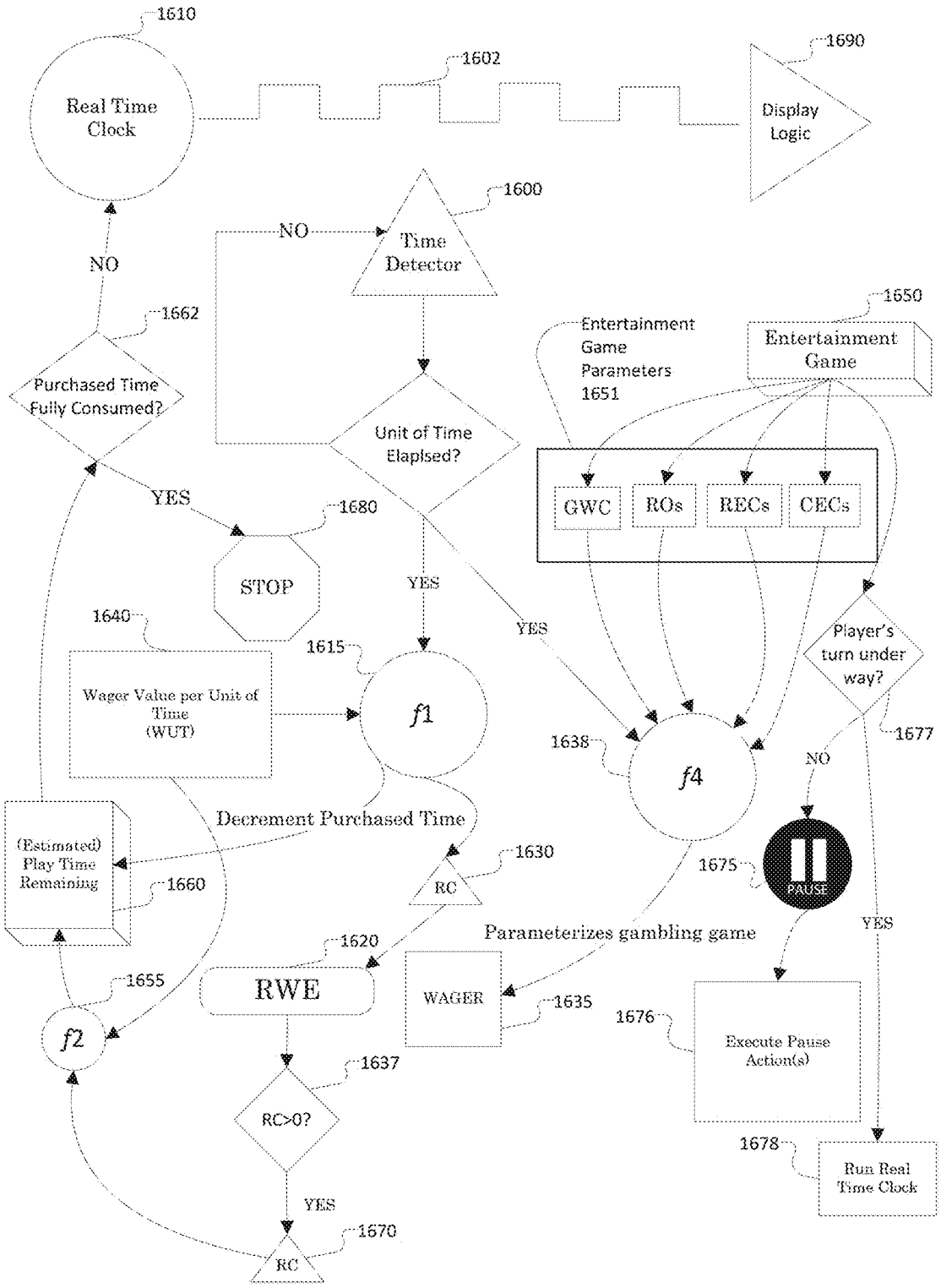
FIG. 16 is a flow chart illustrating another process of a time enabled hybrid game in accordance with an embodiment of the invention.

FIG. 16 is a flow chart illustrating another process of a time enabled hybrid game in accordance with an embodiment of the invention. In various embodiments, the pause function 1675 may be initiated by the hybrid game itself, rather than directly by a player.

In various embodiments, a bet is triggered in a time enabled hybrid game as follows. A time detector 1600 monitors the output 1602 of a clock 1610. The clock 1610 may be a real time clock or a game time clock. A single time detector 1600 may monitor one or more such clocks 1610 within a time enabled hybrid game.

In some embodiments, multiple time detectors 1600 (and the other entities described in this diagram as well) can exist simultaneously within a time enabled hybrid game.

In various embodiments, once a unit of time is detected 1612, the function f1 1615 triggers a wager in the RWE 1620 by (1) determining the amount of RC 1630 to be committed to the wager 1635, and then (2) communicating this to the RWE 1620.

In some embodiments, the function f4 1638 is also invoked, by the time detector 1600, once a unit of time is detected 1612, in the same manner as f1 1615. Function f4 1638 may alter the parameters of the gambling game, such as the pay table based upon input from the entertainment game 1650, and entertainment game parameters 1651. As a function of these factors the player might experience a more or less lucrative pay table. As an example, if a player were to use a cheat, or a hint, to improve their performance in the entertainment game, this might result in a less lucrative pay table. In contrast, if a player were to complete a task in less time than that allowed, they might experience a more lucrative pay table.

In various embodiments, the determination as to the amount of RC 1630 to be committed to the gambling game is a function of the WUT 1640, via function f1 1615.

In some embodiments, function f1 1615, serves to decrement the amount of play time remaining 1660, as it is triggered by the time detector 1600.

In various embodiments, once the wager 1635 takes place, if a winning result is achieved 1637, RC 1670 is returned to the player, and a function, f2 1655, establishes how much (if any) additional time is to be accreted to the player's play time remaining 1660 variable. This too takes WUT 1640, and by extension all its precedent inputs, as input.

In some embodiments, the entertainment game 1650, may have the ability to execute a pause function 1675, to pause the real time clock, and execute pause actions 1676, while the players clock is paused. An example of this functionality is a turn based game, where the player has a limited amount of time in which to play their portion of the game. While the players turn is under way, the real time clock 1610 is run 1678. Once the player has completed their turn 1677, the entertainment game can pause 1675 the clock 1610, while the player waits for their opponent (another player or the computer) to complete their turn, or execute pause action(s) 1676.

In various embodiments, when limited, the game is undertaken in the context of allocated time or play time remaining 1660. Once the play time remaining 1660 is fully depleted 1662, the stop function 1680 is called. Upon stop 1680, the game may be over, and the player, if they want to continue, may have to begin a new game session, or the player may be required to commit additional RC to continue the same game session, or begin a new game session, for example.

In many embodiments, the game clock 1610 output 1602 is input to display logic 1690 that, as part of the ESE or GWE, conditions this output for display to the player. The display logic 1690 can perform mathematical (for example integrate, subtract, add) and/or logic functions on the clock output and display the results of these function(s) and/or convey this information to other subsystems within the GWE and/or ESE.

In another embodiment, of a time enabled hybrid game implementation of a game of chess, where a player is competing against a computer opponent. The player purchases an amount of real time in which to play the game as a function of the amount of RC 1630 put into the game and WUT 1640. The WUT 1640 is calculated as a function of the player's professed skill and other variables. In one embodiment, the WUT 1640 is inversely proportional to how well the player is performing in the chess game (for example if the player is demolishing the computer he will have to bet more, this may be calculated as a function of the number of opponents' pieces captured or their point value relative to a standard.)

In another embodiment, in a time enabled hybrid game of chess, WUT 1640 is fixed throughout the entire game, and so at the onset of the game, the player inserts a specific amount of RC 1630 which in turn correlates to a specific amount of real time game play, for example 1 hour. Continuing this example using a fixed WUT 1640, assume the player inserts $6, and that WUT 1640 is $0.1 per minute.

In several such embodiments, the players can pause the clock(s) in a game. Several such embodiments subsume the case where the game can execute a pause function 1675. In chess, when a player completes his move, the clock is paused by the game while the computer makes its move. When the computer's move is complete, the real time clock is set to running again.

In many such embodiments, each minute of time during a player's turn (the detection of which may span multiple turns), a bet of $0.1 is initiated by f1 1615. The odds of the gambling game (the pay tables) are set by f4 1638 as a function of various entertainment game variables. While this function, f4 1638, need not apply, in this example, players performing to a higher level during the chess game gain slightly better odds in the gambling game.

In several such embodiments, if the gambling game delivers a positive result the amount of time available for game play (game time remaining 1660) is increased. Because WUT 1640 is constant in this example, the amount of purchased time is readily calculated (rather than estimated).

In many such embodiments, the chess game ends when either (a) the computer is placed in checkmate or surrenders, (b) the player is placed in checkmate or surrenders, or (c) there is no more purchased time remaining. In the case of (a) or (b) the player may cash out their remaining RC 1670. In the case of (c) the player may be given the option to contribute more RC 1630 and thereby acquire more play time remaining 1660.

In many embodiments, time enabled hybrid games can also support head-to-head games. For example, a head-to-head chess game would operate largely as diagrammed in FIG. 15, with each player having their own WUT 1640, play time remaining 1660 value, RC, etc. The entertainment game, and its variable sets would apply to both players, as would the underlying functions f1 1615 and f4 1638. The process of gambling would take place sequentially. The first player to move (white) would commence their move, a bet would be placed, etc. Then the second player to move (black) would commence their move, a bet would be placed, etc.

Note that in various embodiments of all of these examples, as with time enabled hybrid games generally, bets can be triggered as a function of a specific amount of real or game time elapsing (for example a minute or a Hectarian Year, etc.) regardless of where this falls relative to a player's turn in games with distinct turn sequences (vs. games with continuous game play) or the bets can be triggered at a specific juncture relative to the turn, such that time is effectively allocated to a task (in the chess example, the task is completing a move).

Figure 17:
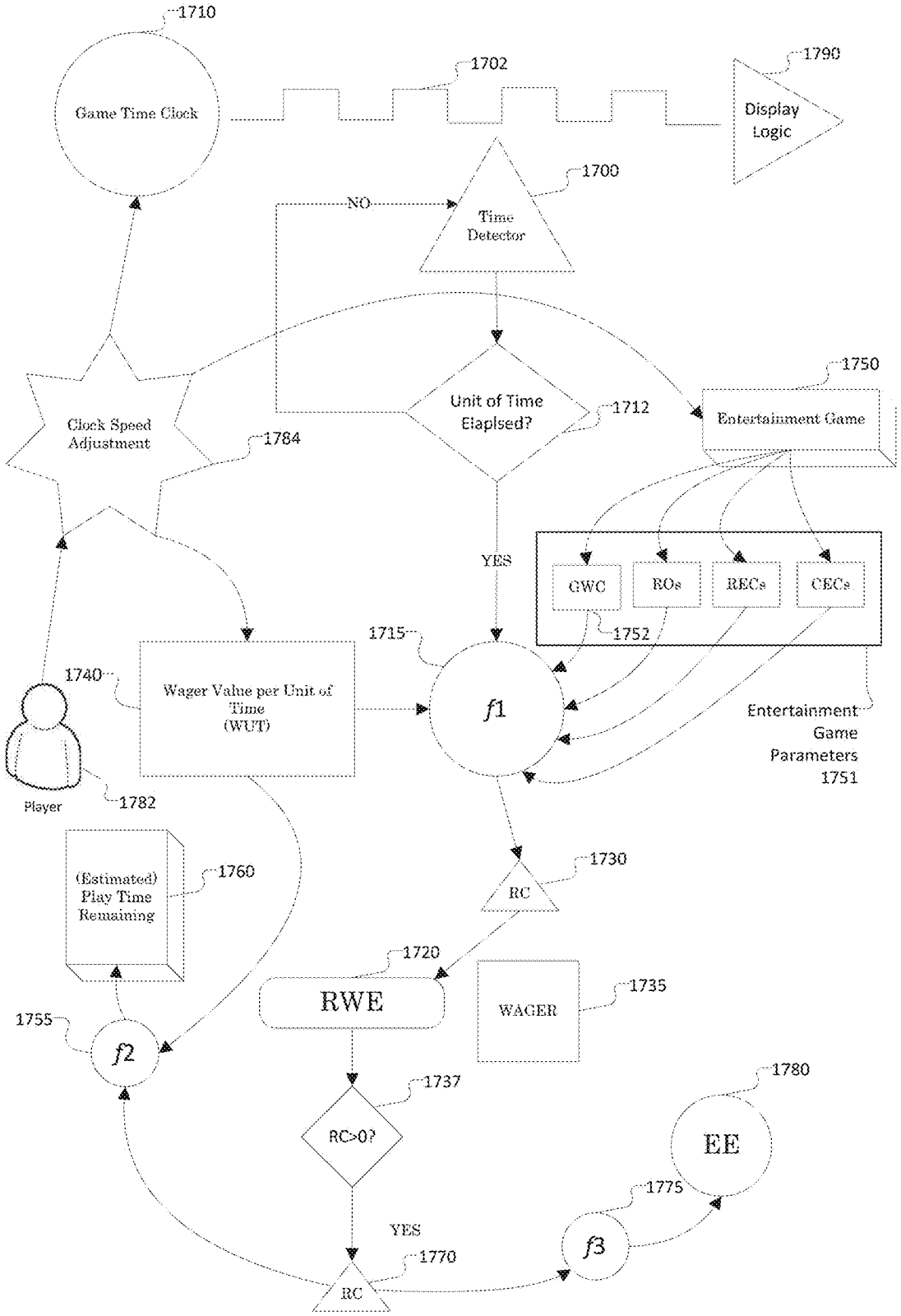
FIG. 17 is a flow chart illustrating another process of a time enabled hybrid game in accordance with an embodiment of the invention.

FIG.17 is a flow chart illustrating another process of a time enabled hybrid game in accordance with an embodiment of the invention. In various embodiments, a bet is triggered in a time enabled hybrid game as follows. A time detector 1700 monitors the output 1702 of a game time clock 1710. A single time detector 1700 may monitor one or more such clocks 1710 within a time enabled hybrid game.

In some embodiments, multiple time detectors 1700 (and the other entities described in this diagram as well) can exist simultaneously within a time enabled hybrid game.

In various embodiments, once a unit of time is detected 1712, the function f1 1715 triggers a wager in the RWE 1720 by (1) determining the amount of RC 1730 to be committed to the wager 1735, and then (2) communicating this to the RWE 1720.

In various embodiments, the determination as to the amount of RC 1730 to be committed to the gambling game is a function of the WUT 1740. f1 1715 may also take into account the state of the entertainment game 1750 or entertainment game parameters 1751 and/or a change in the state of the entertainment game 1750.

In various embodiments, once the wager 1735 takes place, if a winning result is achieved 1737, RC 1770 is returned to the player, and a function, f2 1755, establishes how much (if any) additional time is to be accreted to the player's purchased time (play time remaining 1760) variable. This too takes WUT 1740, and by extension all its precedent inputs, as input.

In many embodiments, the amount of RC 1770 generated also affects, via f3 1775, the amount of EE 1780 available to a player's controlled entity (CE) in the game. This functionality is present in implementations where EE 1780, in addition to purchased time 1760, is part of the time enabled hybrid game construct.

In other embodiments, f2 1755 always returns zero, such that only f3 1775 is active. Several such embodiments relate to the case where a fixed amount of time (real or game) need not be purchased, but rather time is not a factor limiting game play, and acts solely as a trigger.

In various embodiments, a player 1782 can attenuate or accelerate the passage of game time during time enabled hybrid game gameplay. The player accesses a user control 1784 to attenuate or accelerate the passage of game time through the game world display, via the display logic 1790. Changing the speed of the game time clock 1710 may or may not be allowed in a time enabled hybrid game, and when allowed may not be accessible during all aspects of game play or at all times during game play.

In some embodiments, when a player alters the game time clock 1710, the rate at which gambling games are initiated changes. The overall speed of game play in the entertainment game 1750, may also be affected. Various other entertainment game parameters 1751 and variables can also be affected, as can the value of WUT 1740.

In many embodiments, the game clock 1710 output 1702 is input to display logic 1790 that, as part of the ESE or GWE, conditions this output for display to the player. The display logic 1790 can perform mathematical (for example integrate, subtract, add) and/or logic functions on the clock output and display the results of these function(s) and/or convey this information to other subsystems within the GWE and/or ESE.

In some embodiments, a time enabled hybrid game where the player is operating a tank and needs to maneuver the tank across terrain, identifying and destroying enemy tanks is provided. At its nominal pace the game requires a certain level of hand-eye coordination and dexterity to aim and fire the tank's guns before the computer controlled opponent can do the same. A player of low dexterity or someone who is unfamiliar with the game may find the controls hard to work with, and choose to slow down the passage of game time to give themselves a better chance to operate the tank controls and destroy enemy tanks. This could have the effect of altering the rate at which the player accumulates GWC 1752, of altering the amount of RC 1730 committed to each gambling event (for example WUT 1740 could increase as a consequence of decelerating game time), and/or altering the gambling game parameters. Likewise, accelerating the game time clock could lead to lower WUT 1740, the use of more lucrative pay tables, and higher GWC 1752 accumulation for enemy tank kills.

Processing Apparatus

Figure 18:
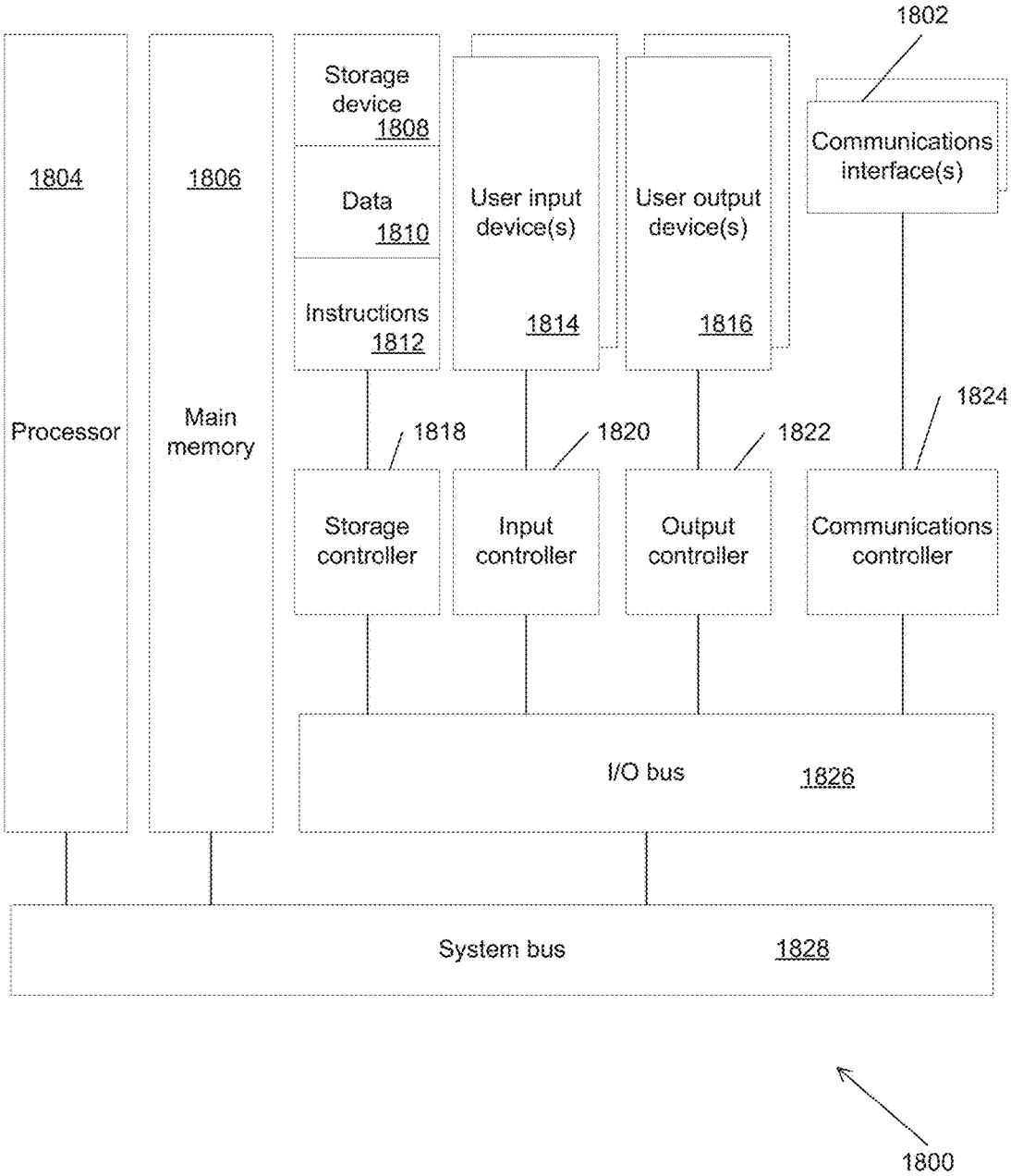
FIG. 18 illustrates a hardware architecture diagram of a processing apparatus utilized in the implementation of a time enabled hybrid game in accordance with an embodiment of the invention.

Any of a variety of processing apparatuses can host various components of a time enabled hybrid game in accordance with embodiments of the invention. In several embodiments, these processing apparatuses can include, but are not limited to, a mobile device such as a tablet computer or smartphone, a casino gaming machine, a general purpose computer such as a personal computer, a gaming console, a server, a computing device and/or a controller. A processing apparatus that is constructed to implement a time enabled hybrid game in accordance with an embodiment of the invention is illustrated in FIG. 18. In the processing apparatus 1800, a processor 1804 is coupled to a memory 1806 by a bus 1828. The processor 1804 is also coupled to non-transitory processor-readable storage media, such as a storage device 1808 that stores processor-executable instructions 1812 and data 1810 through the system bus 1828 to an I/O bus 1826 through a storage controller 1818. The processor 1804 is also coupled to one or more interfaces that may be used to connect the processor to other processing apparatuses as well as networks as described herein. The processor 1804 is also coupled via the bus to user input devices 1814, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 1804 is connected to these user input devices 1814 through the system bus 1828, to the I/O bus 1826 and through the input controller 1820. The processor 1804 is also coupled via the bus to user output devices 1816 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1828 to the I/O bus 1826 and through the output controller 1822. The processor 1804 can also be connected to a communications interface 1802 from the system bus 1828 to the I/O bus 1826 through a communications controller 1824.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any of an RWE, GWE or ESE as described herein can be implemented on multiple processing apparatuses, whether dedicated, shared or distributed in any combination thereof, or may be implemented on a single processing apparatus. In addition, while certain aspects and features of processes described herein have been attributed to an RWE, GWE, or ESE, these aspects and features may be implemented in a hybrid form where any of the features or aspects may be performed by any of a RWE, GWE, ESE within a time enabled hybrid game without deviating from the spirit of the invention.

While the above description includes many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A distributed gaming system, comprising:

an electromechanical gaming machine constructed to receive real credits from a user connected to a real world server by a communication link;

the real world server connected to a game world server by a communication link, wherein the real world server is constructed to:

receive from the game world server via the communication link, a trigger of a wager;

execute the wager to determine a randomly generated payout of real credits using a random number generator; and distribute to the game world server via the communication link, the randomly generated payout of real credits;

an entertainment software server connected to the game world server by a network, wherein the entertainment software server is constructed to:

execute an entertainment game having a game world clock in a game world environment, and an entertainment game element that is consumed by an action of a player in the game world environment;

distribute to the game world server via the network, an output of the game world clock and the player action;

receive from the game world server via the network, control information including an amount of the entertainment game element in the game world environment;

make available to the player the amount of the entertainment game element during the player's skillful play of the entertainment game; and provide outcomes based upon the player's skillful play of the entertainment game and use of the amount of the entertainment game element;

generate a visual display of the entertainment game; and the game world server connected by the communication link to the real world server and connected to entertainment software server by the network, wherein the game world server is constructed to:

interface the entertainment software server to the real world server over the network by:

receiving from the entertainment software server via the network, the output of the game world clock and the player action;

monitoring the output of the game world clock during the player's skillful play of the entertainment game;

detecting passage of a unit of game world time in the game world environment based on the monitored output of the game world clock;

distributing to the real world server via the communication link, the trigger of the wager in based on both the detection of the passage of the unit of game world time in the game world environment, and on the entertainment game element being consumed by the action of the player in the game world environment;

receiving from the real world server via the communication link, the randomly generated payout; and controlling the entertainment software server by:

determining, based on the randomly generated payout, the control information including the amount of the entertainment game element available in the game world environment to the player while playing the entertainment game;

distributing to the entertainment software server via the network, the control information; and accreting, based on the randomly generated payout, an amount of game world time in the game world environment for use by the player while playing the entertainment game.

2. The distributed gaming system of claim 1, wherein triggering the wager in the gambling game further includes determining the amount of real credit committed to the wager.

3. The distributed gaming system of claim 2, wherein the amount of real credit committed to the wager is determined on the basis of the unit of game world time.

4. The distributed gaming system of claim 1, wherein the game world server and the real world server are implemented on a same processing apparatus.

5. The distributed gaming system of claim 1, wherein the communication link connecting the game world server and the real world server utilizes the network.

* * * * *